US009997881B2

(12) United States Patent
Itou

(10) Patent No.: US 9,997,881 B2
(45) Date of Patent: Jun. 12, 2018

(54) ELECTRIC CONNECTOR

(71) Applicant: Japan Aviation Electronics Industry, Ltd, Tokyo (JP)

(72) Inventor: Yasukazu Itou, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days. days.

(21) Appl. No.: 15/312,309

(22) PCT Filed: May 27, 2015

(86) PCT No.: PCT/JP2015/002671
§ 371 (c)(1),
(2) Date: Nov. 18, 2016

(87) PCT Pub. No.: WO2015/182132
PCT Pub. Date: Dec. 3, 2015

(65) Prior Publication Data

US 2017/0117675 A1 Apr. 27, 2017

(30) Foreign Application Priority Data

May 30, 2014 (JP) ..... 2014-112215

(51) Int. Cl.
*H01R 4/10* (2006.01)
*H01R 31/06* (2006.01)
(Continued)

(52) U.S. Cl.
CPC ..... *H01R 31/06* (2013.01); *H01R 11/12* (2013.01); *H01R 24/68* (2013.01); *H01R 2101/00* (2013.01)

(58) Field of Classification Search
CPC ..... H01R 13/5219; H01R 13/4223; H01R 13/4362; H01R 4/185
(Continued)

(56) References Cited

U.S. PATENT DOCUMENTS 5,609,503 A * 3/1997 Tsuji ..... H01R 13/4362 439/733.1
5,645,448 A 7/1997 Hill
(Continued)

FOREIGN PATENT DOCUMENTS

CN 101208833 A 6/2008
CN 103119790 5/2013
(Continued)

OTHER PUBLICATIONS

Extended European Search Report dated Apr. 13, 2017, including the Supplementary Search Report and the European Search Opinion, in connection with corresponding EP Application No. 15798777.7 (8 pgs.).
(Continued)

*Primary Examiner* — Thanh Tam Le
(74) *Attorney, Agent, or Firm* — Maier & Maier, PLLC

(57) ABSTRACT

A pin connector includes a pin contact and a pin housing. The pin contact includes a battery fixing portion and a contact portion. The pin housing includes a pin housing body into which the contact portion is inserted in a connector removal direction, and a pin contact lock. When the pin contact lock is inserted into the pin housing body in a battery separating direction to be attached to the pin housing body, a projection upper surface faces a groove ceiling and a lower surface faces a contact lock surface.

20 Claims, 28 Drawing Sheets

(51) Int. Cl.
*H01R 11/12* (2006.01)
*H01R 24/68* (2011.01)
*H01R 101/00* (2006.01)

(58) Field of Classification Search
USPC ..... 439/271, 595, 752, 752.5, 877
See application file for complete search history.

(56) References Cited

U.S. PATENT DOCUMENTS 5,653,613 A * 8/1997 Shimoda ..... H01R 13/4361 439/752
6,010,374 A * 1/2000 Miwa ..... H01R 13/4362 439/752
6,994,598 B2 * 2/2006 Holmes ..... H01R 13/4361 439/752
7,059,918 B2 * 6/2006 Matsumoto ..... B60L 11/1898 439/752
7,077,676 B2 * 7/2006 Matsumoto ..... H01R 13/5205 439/271
7,559,789 B2 * 7/2009 Hashim ..... H01R 4/2433 439/405
7,811,126 B1 * 10/2010 Chen ..... H01R 13/42 439/595
8,096,841 B2 * 1/2012 Hirano ..... H01R 13/4361 439/752
8,128,431 B2 * 3/2012 Kato ..... H01R 13/521 439/271
8,827,745 B2 * 9/2014 Tsujii ..... H01R 13/4223 439/587
9,190,767 B2 * 11/2015 Makimura ..... H01R 13/5219
9,337,567 B2 * 5/2016 Rangi ..... H01R 13/5202
2013/0171853 A1 7/2013 Tsujii et al.

FOREIGN PATENT DOCUMENTS

JP 2002-358867 A 12/2002
JP 2010-251176 A 11/2010
JP 2012-69347 A 4/2012
WO 2014/038114 A1 3/2014

OTHER PUBLICATIONS

International Search Report dated Aug. 25, 2015 in corresponding Application No. PCT/JP2015/002671; 1 pg.
Office Action dated Aug. 3, 2016 in the corresponding Taiwanese Patent Application No. 104116089; 12 pgs.
Office Action dated Aug. 18, 2018 in the corresponding Japanese Patent Application No. 2014-112215; 8 pgs.
European Office Action dated Feb. 2, 2018, in connection with corresponding EP Application No. 15 798 777.7 (6 pgs.).
Chinese Office Action dated Mar. 19, 2018, in connection with corresponding CN Application No. 201580027923.9 (10 pgs., including English translation).

* cited by examiner

ELECTRIC CONNECTOR

TECHNICAL FIELD

The present invention relates to an electric connector.

BACKGROUND ART

As a technique of this type, Patent Literature 1 discloses a technique in which, as shown in FIG. 30 of the present application, an input terminal 100 to be connected to a battery and a bus bar 102 including tab-like output terminals 101 are accommodated in a box 103 in a state where they are prevented from being disengaged from each other. In Patent Literature 1, a resin mold portion 104 which sandwiches the front and back surfaces of the bus bar 102 is provided and projections 105 which are respectively provided on the right and left sides of the resin mold portion 104 are elastically engaged with lock pieces 106 which are provided on right and left wall surfaces of the box 103.

CITATION LIST

Patent Literature

Patent Literature 1: Japanese Unexamined Patent Application Publication No. 2002-358867

SUMMARY OF INVENTION

Technical Problem

An electric connector including a contact and a housing has the following problem. That is, for example, when the contact is fixed to an object to be fixed, such as a battery, and an external force acts on the housing, the housing may be detached from the contact. When the external force acts in an insertion direction in which the contact is inserted into the housing and attached thereto, the above-mentioned problem of detachment becomes more noticeable.

An object of the present invention is to provide a technique for preventing an electrical connection between an electric wire and a connection object from being lost due to detachment of a housing of an electric connector from a contact when an external force acts on the housing.

Solution to Problem

According to an aspect of the present invention, an electric connector configured to be attached to a connection object is provided, the electric connector being configured to be mated to a mating connector attached to an electric wire to thereby electrically connect the electric wire to the connection object, the electric connector including: a contact; and a housing attached to the contact. The contact includes a first contact portion having a flat plate shape and a second contact portion having a flat plate shape, the first contact portion being configured to be fixed to the connection object, the second contact portion being configured to be in contact with the mating connector. The housing includes: a housing body into which the second contact portion is inserted in a removal direction; and a contact lock attached to the housing body, the removal direction being opposite to a mating direction in which the mating connector is mated to the electric connector. The contact lock includes a first lock surface facing in the mating direction and a second lock surface facing in the removal direction. The housing body includes a housing lock surface facing in the removal direction. The contact includes a contact lock surface facing in the mating direction. When the contact lock is inserted into the housing body in a direction substantially orthogonal to the removal direction to be attached to the housing body, the first lock surface faces the housing lock surface and the second lock surface faces the contact lock surface.

Advantageous Effects of Invention

According to the present invention, it is possible to prevent an electrical connection between an electric wire and a connection object from being lost due to detachment of a housing of an electric connector from a contact when an external force acts on the housing.

DESCRIPTION OF EMBODIMENTS

First Embodiment

Figure 1:
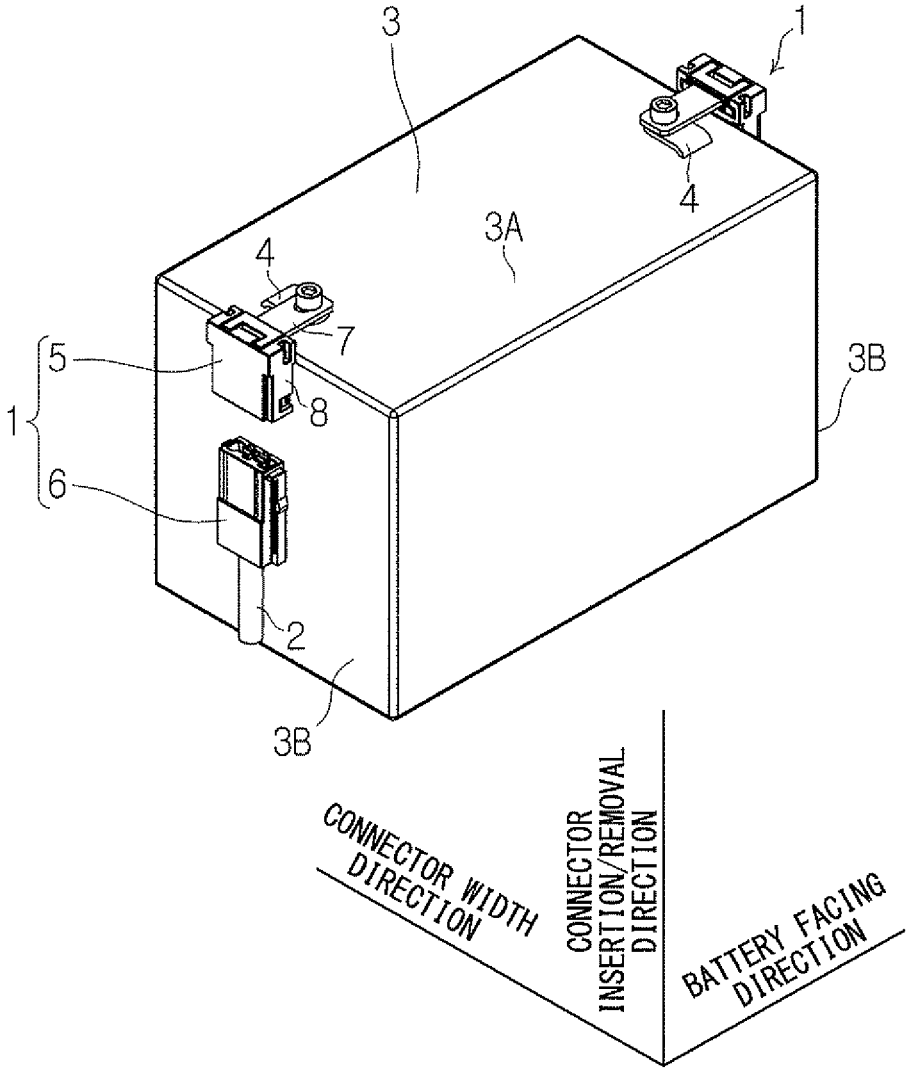
FIG. 1 is a perspective view showing a state before a socket connector is mated to a pin connector (first embodiment)
Figure 2:
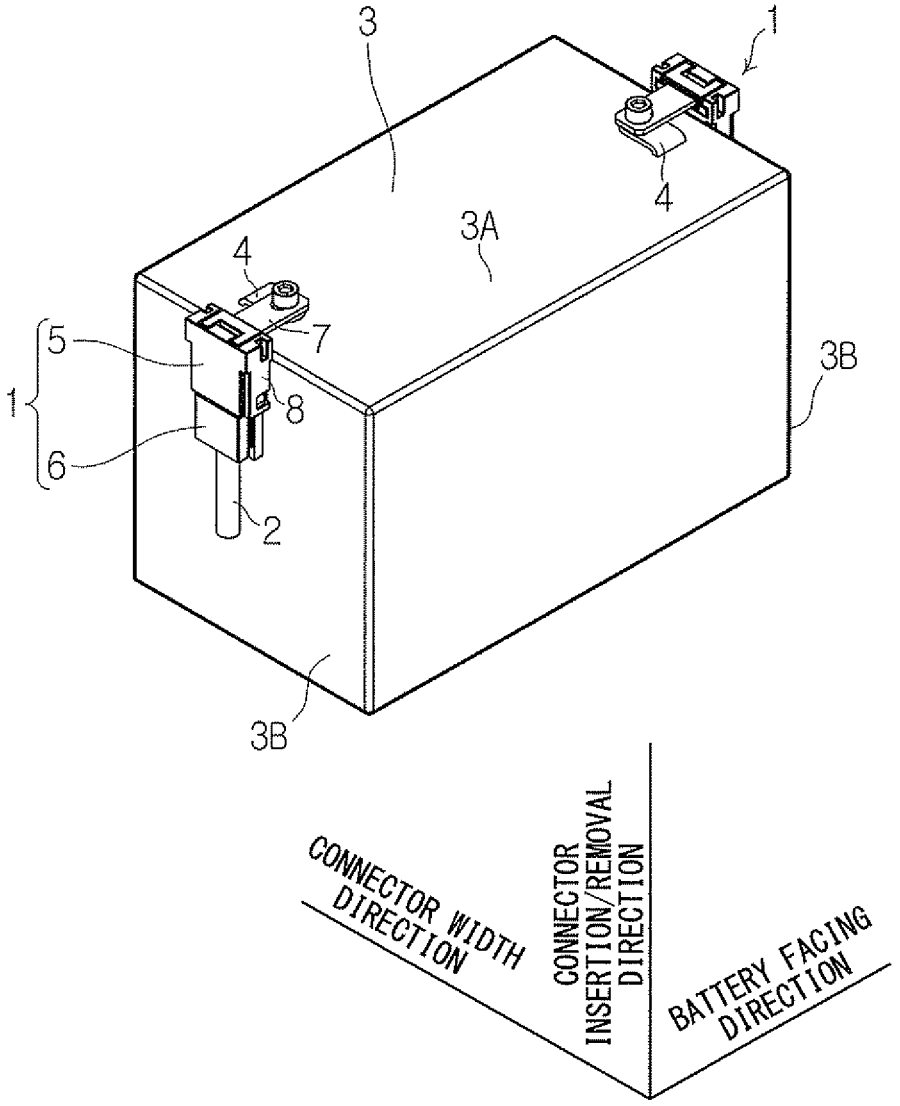
FIG. 2 is a perspective view showing a state after the socket connector is mated to the pin connector (first embodiment)

A first embodiment will be described below with reference to FIGS. 1 to 24. FIGS. 1 and 2 show a state where each electric wire 2 is connected to a battery unit 3 (connection object) using a connector assembly 1. As shown in FIGS. 1 and 2, in this embodiment, the battery unit 3 has a substantially rectangular parallelepiped shape and includes an upper surface 3A and a pair of side surfaces 3B. A pair of external terminals 4 is disposed on the upper surface 3A.

The connector assembly 1 includes a pin connector 5 (electric connector) to be attached to the corresponding external terminal 4 of the battery unit 3, and a socket connector 6 (mating connector) to be attached to the corresponding electric wire 2. As shown in FIG. 2, the socket connector 6 is mated to the pin connector 5, thereby electrically connecting each electric wire 2 to the corresponding external terminal 4 of the battery unit 3.

As shown in FIG. 1, the pin connector 5 includes a pin contact 7 (contact) and a pin housing 8 (housing) attached to the pin contact 7. When the pin contact 7 is attached to the external terminal 4 of the battery unit 3, the pin housing 8 faces the corresponding side surface 3B of the battery unit 3.

Referring to FIGS. 1 and 2, the terms "connector insertion/removal direction (first direction)", "battery facing direction (second direction)", and "connector width direction (third direction)" will now be defined. The connector insertion/removal direction, the battery facing direction, and the connector width direction are orthogonal to each other. The connector insertion/removal direction is a direction in which the socket connector 6 is inserted into the pin connector 5 and is removed therefrom. The connector insertion/removal direction includes a connector mating direction (mating direction) and a connector removal direction (removal direction). The connector mating direction is a direction in which the socket connector 6 is mated to the pin connector 5. The connector removal direction is a direction in which the socket connector 6 is removed from the pin connector 5. The battery facing direction is a direction in which the pin housing 8 of the pin connector 5 and the side surfaces 3B of the battery unit 3 face each other. The battery facing direction includes a battery approaching direction and a battery separating direction. The battery approaching direction is a direction in which the side surfaces 3B of the battery unit 3 are viewed from the pin housing 8 of the pin connector 5. The battery separating direction is a direction in which the pin housing 8 of the pin connector 5 is viewed from the side surfaces 3B of the battery unit 3. The connector width direction is a direction orthogonal to the connector insertion/removal direction and the battery facing direction. The connector width direction includes a connector width center direction (inward) and a connector width anti-center direction (outward). The connector width center direction is a direction approaching toward the center of the pin connector 5 in the connector width direction. The connector width anti-center direction is a direction moving away from the center of the pin connector 5 in the connector width direction.

FIGS. 1 and 2 illustrate two connector assemblies 1 and the two connector assemblies 1 have the same structure. Accordingly, only one of the connector assemblies 1 will be described below, while the description of the other one of the connector assemblies 1 will be omitted.

(Pin Connector 5)

Figure 3:
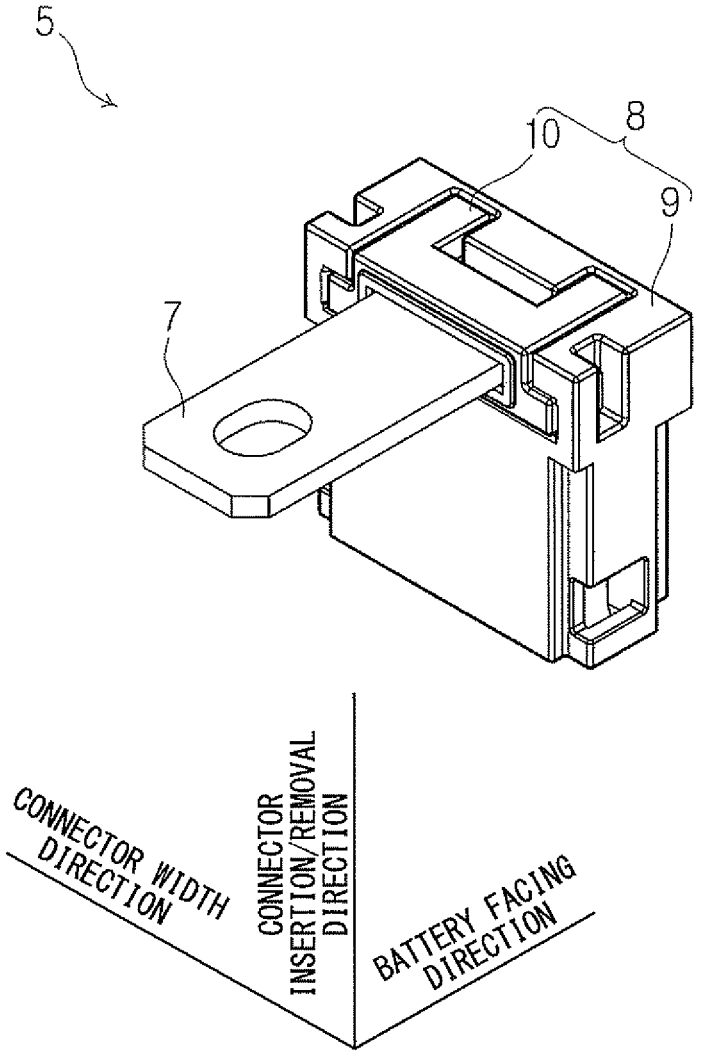
FIG. 3 is a perspective view of the pin connector (first embodiment)
Figure 4:
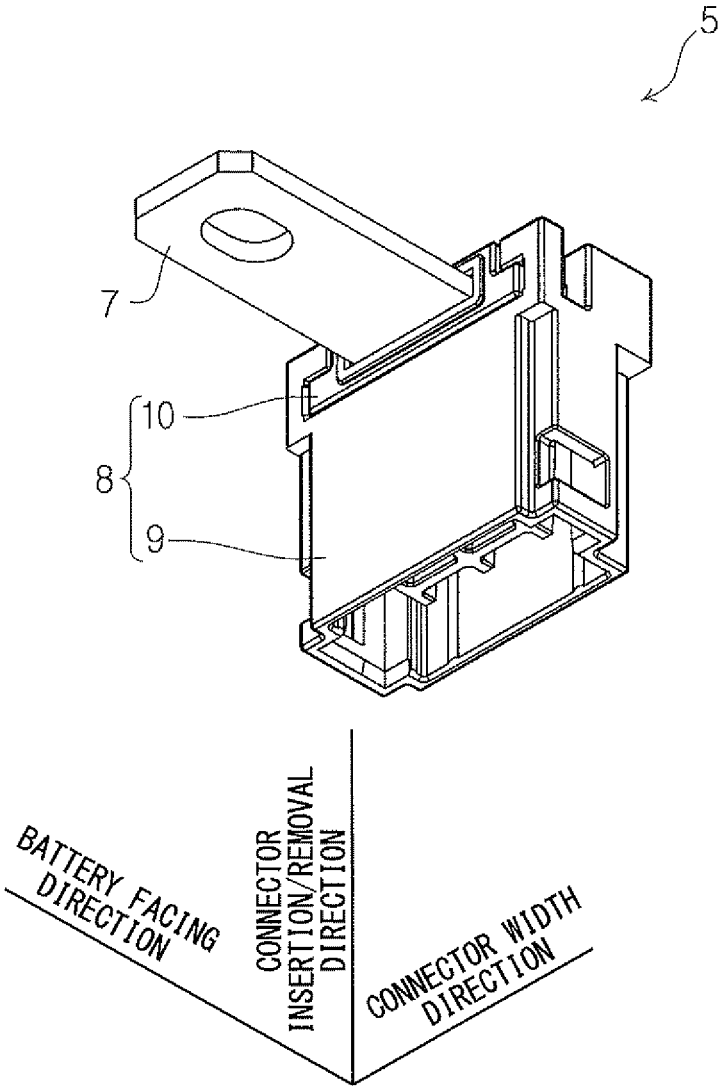
FIG. 4 is a perspective view of the pin connector when viewed from another angle (first embodiment)

FIGS. 3 and 4 illustrate the pin connector 5 when viewed from different directions. As described above, the pin connector 5 includes the pin contact 7 and the pin housing 8. The pin housing 8 includes a pin housing body 9 and a pin contact lock 10 (contact lock) attached to the pin housing body 9. As shown in FIGS. 5 to 8, the pin contact 7 is inserted into the pin housing body 9 and the pin contact lock 10 is attached to the pin housing body 9, thereby allowing the pin contact 7 to be fixed to the pin housing body 9.

(Pin Housing Body 9)

Figure 9:
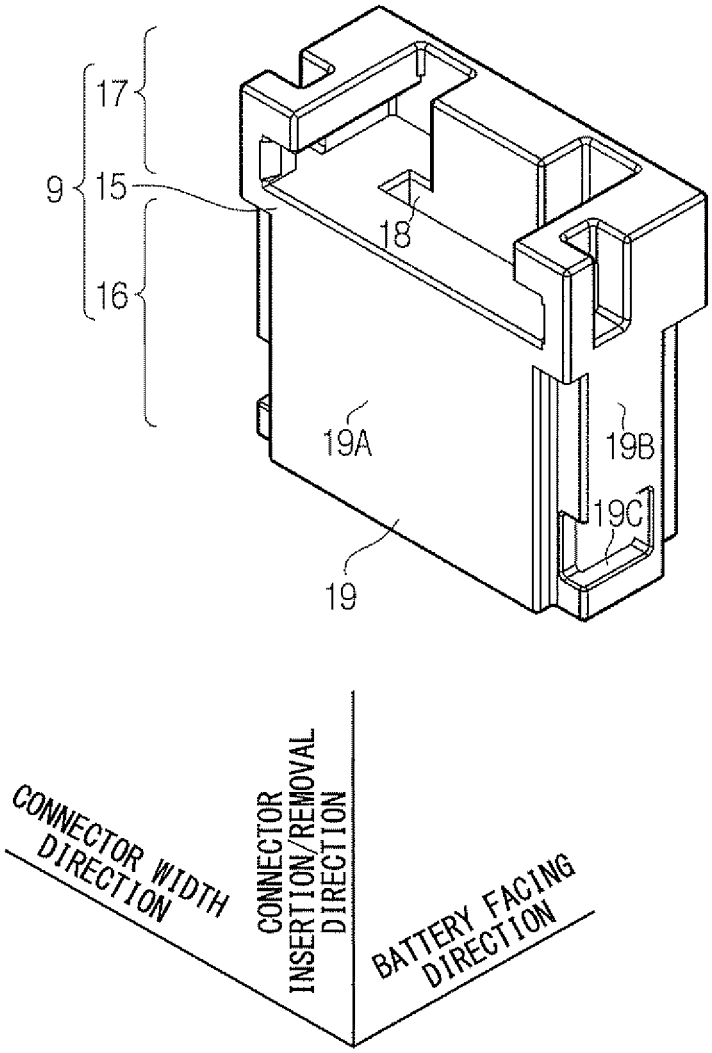
FIG. 9 is a perspective view of a pin housing body (first embodiment)
Figure 10:
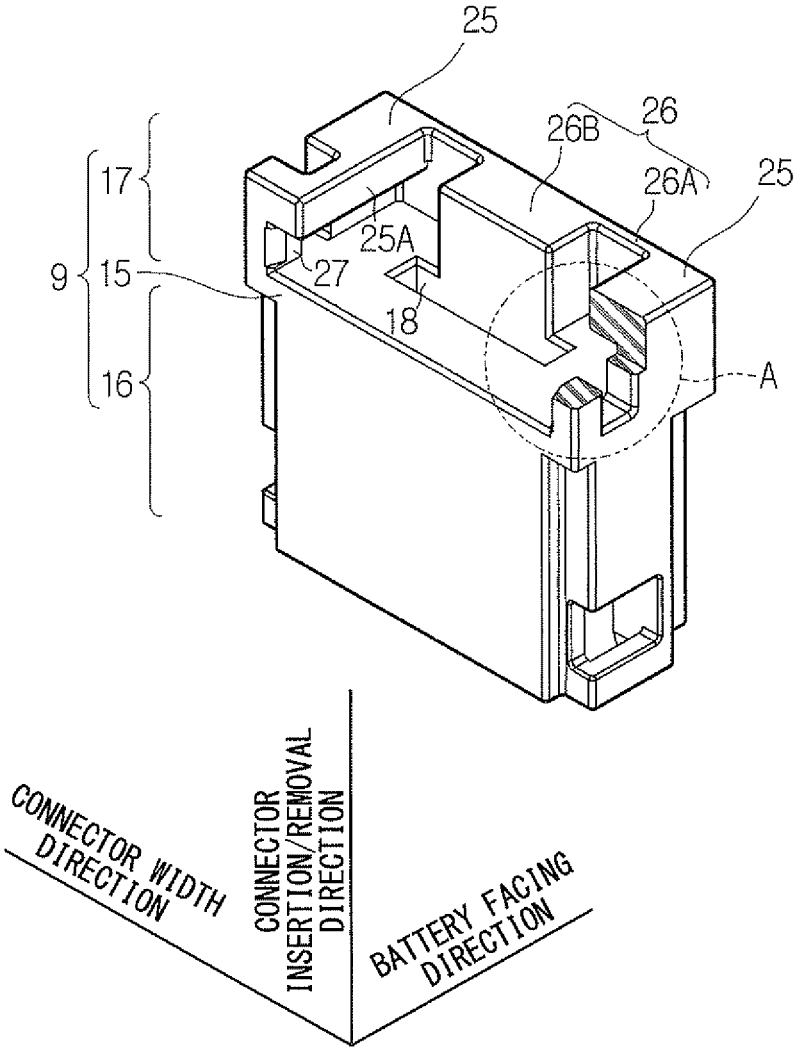
FIG. 10 is a partially cutaway perspective view of the pin housing body (first embodiment)
Figure 11:
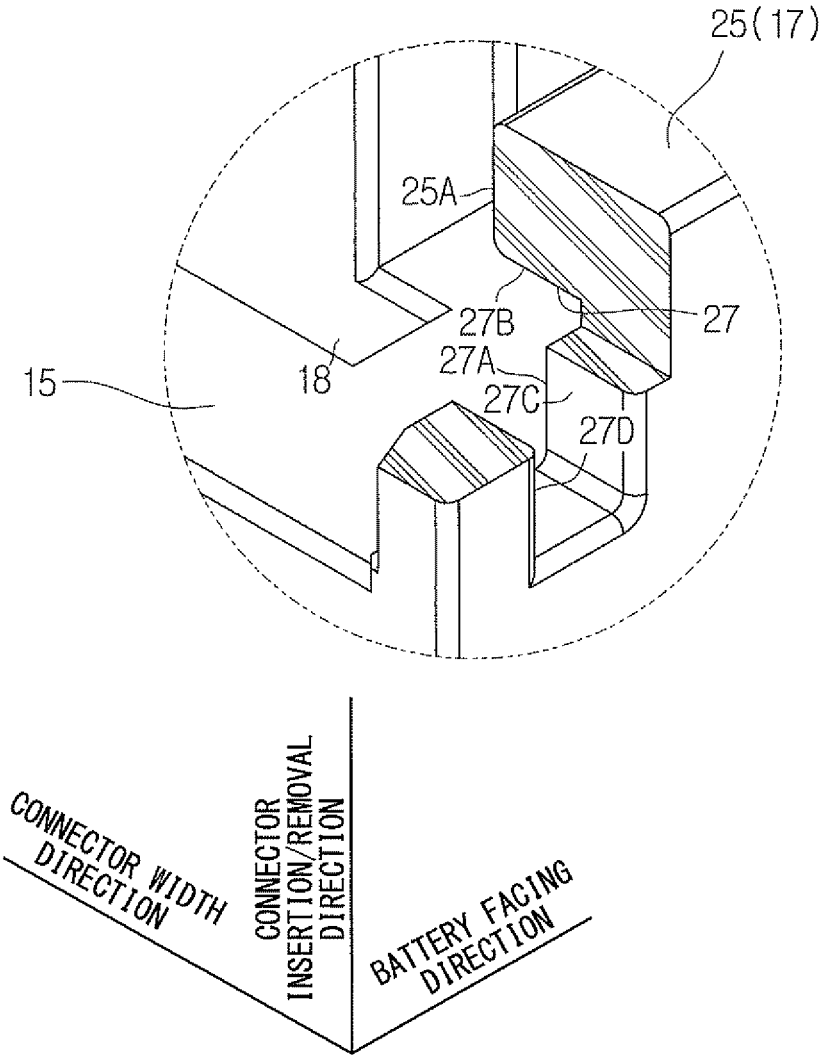
FIG. 11 is an enlarged view of a portion "A" shown in FIG. 10 (first embodiment)
Figure 12:
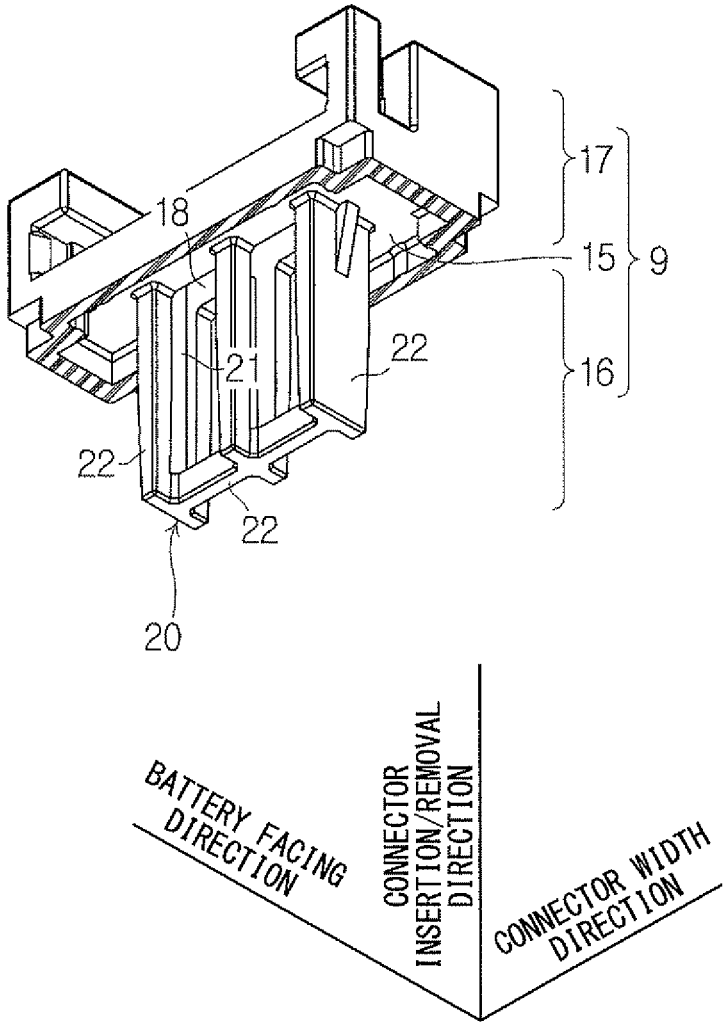
FIG. 12 is a partially cutaway perspective view of the pin housing body when viewed from another angle (first embodiment)

Referring to FIGS. 9 and 12, the pin housing body 9 will be described. FIG. 9 shows a perspective view of the pin housing body 9. FIGS. 10 to 12 each shows a partially cutaway perspective view of the pin housing body 9. As shown in FIG. 9, the pin housing body 9 includes a base plate 15, a mating portion 16, and a pin contact lock accommodating portion 17.

As shown in FIGS. 9 and 12, the base plate 15 is a flat-plate-shaped portion. The base plate 15 has a contact insertion hole 18 penetrating the base plate 15 in the connector insertion/removal direction.

As shown in FIGS. 9 and 12, the mating portion 16 includes an outside cover 19 and an inside cover 20. FIG. 12 illustrates the pin housing body 9 in a state where the illustration of the outside cover 19 is omitted for convenience of description of the inside cover 20. As shown in FIG. 9, the outside cover 19 is formed so as to have a rectangular tubular shape which projects from the base plate 15 in the connector removal direction. The outside cover 19 includes a pair of large side walls 19A facing each other in the battery facing direction, and a pair of small side walls 19B facing each other in the connector width direction. Claw mating surfaces 19C are formed on the small side walls 19B, respectively. As shown in FIG. 12, the inside cover 20 is formed so as to project from the base plate 15 in the connector removal direction on the inside of the outside cover 19. The inside cover 20 forms a contact accommodation space 21 which communicates with the contact insertion hole 18 of the base plate 15. The inside cover 20 is formed of a plurality of beams 22 surrounding the contact accommodation space 21.

As shown in FIG. 10, the pin contact lock accommodating portion 17 is formed so as to project from the base plate 15 in the connector mating direction. The pin contact lock accommodating portion 17 includes a pair of lock holding walls 25 facing each other in the connector width direction, and a lock abutting wall 26 which is disposed at a location farther from the battery unit 3 than the contact insertion hole 18. An insertion groove 27 extending in the battery facing direction is formed in the wall surface 25A on the connector width center direction side of each lock holding wall 25. Specifically, as shown in FIG. 11, each lock holding wall 25 includes: a groove side surface 27A that defines the connector width anti-center direction of the insertion groove 27; and a groove ceiling 27B (housing lock surface) that defines the connector mating direction of the insertion groove 27. Each lock holding wall 25 further includes a hook hole 27C extending in the connector width anti-center direction from the groove side surface 27A; and a hook surface 27D that defines the battery approaching direction of the hook hole 27C. As shown in FIG. 10, the lock abutting wall 26 includes: an abutting wall body 26A whose thickness direction matches the battery facing direction; and an abutting wall projecting portion 26B that projects in the battery approaching direction from the center of the abutting wall body 26A in the connector width direction.

(Pin Contact Lock 10)

Figure 13:
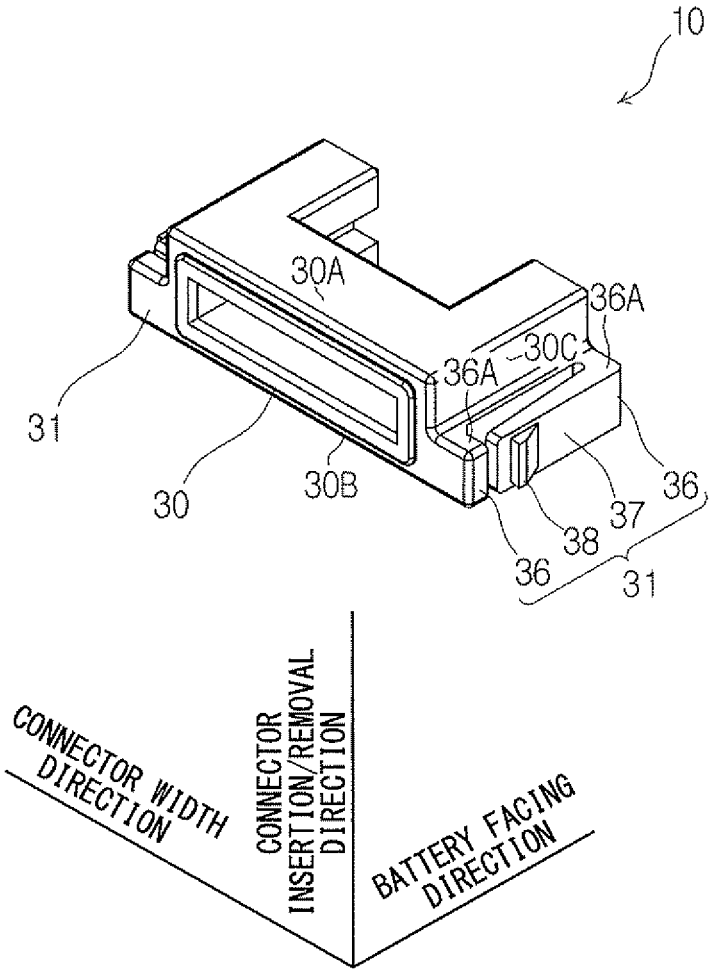
FIG. 13 is a perspective view of a pin contact lock (first embodiment)
Figure 14:
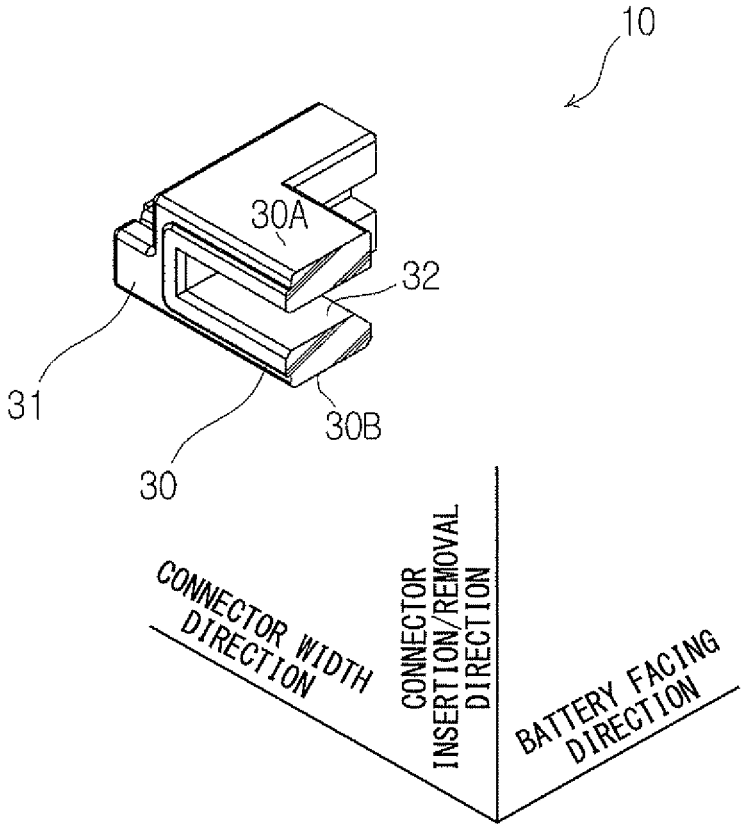
FIG. 14 is a partially cutaway perspective view of the pin contact lock (first embodiment)
Figure 15:
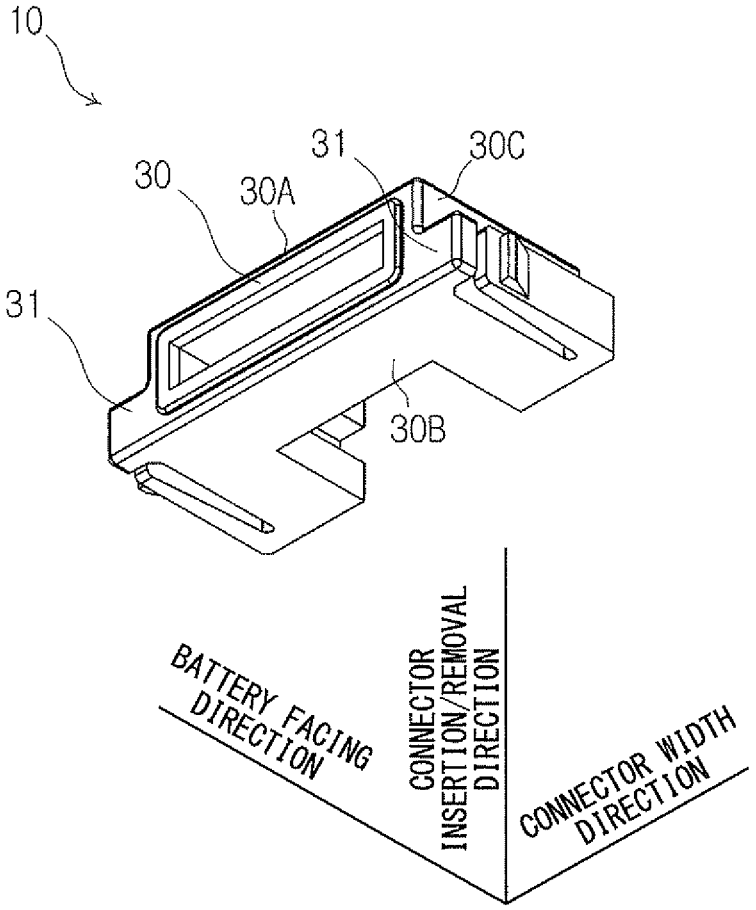
FIG. 15 is a perspective view of the pin contact lock when viewed from another angle (first embodiment)
Figure 16:
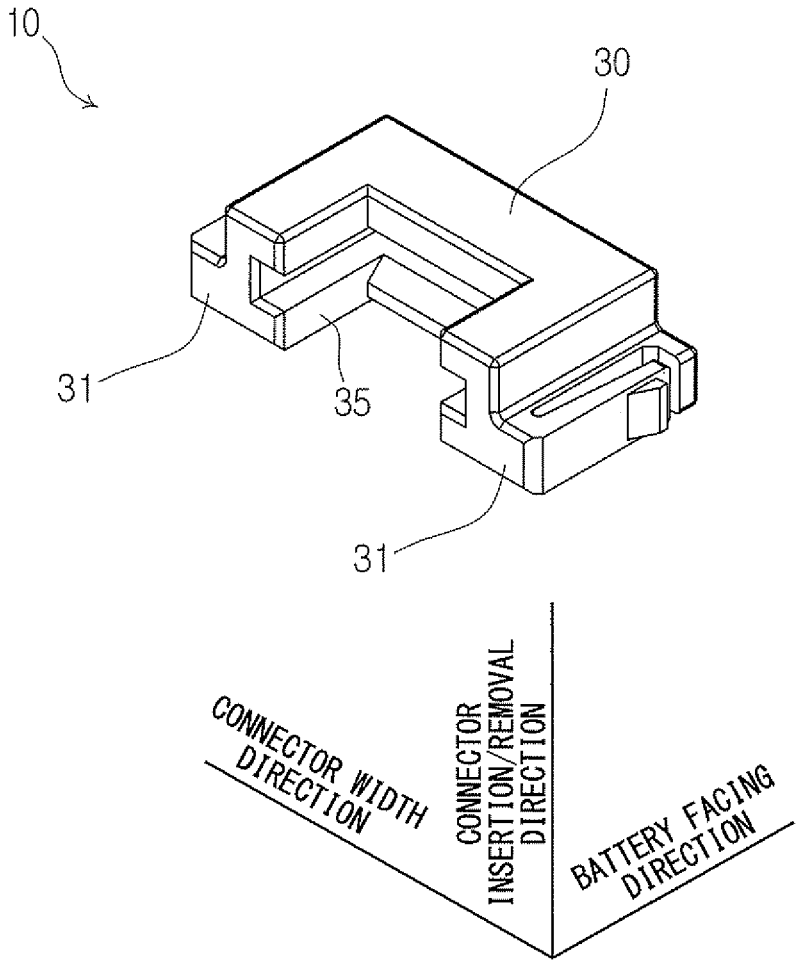
FIG. 16 is a perspective view of the pin contact lock when viewed from another angle (first embodiment)

Next, the pin contact lock 10 will be described with reference to FIGS. 13 to 16. FIGS. 13, 15, and 16 illustrate the pin contact lock 10 when viewed from different angles. FIG. 14 shows a partially cutaway perspective view of the pin contact lock 10.

As shown in FIGS. 13 to 16, the pin contact lock 10 includes a contact holding portion 30 and a pair of insertion portions 31.

As shown in FIG. 13, the contact holding portion 30 is a portion having a rectangular tubular shape extending in the battery facing direction. As shown in FIG. 14, the contact holding portion 30 includes a contact through-hole 32 that penetrates in the battery facing direction. As shown in FIGS. 13 to 15, the contact holding portion 30 includes: an upper surface 30A facing in the connector mating direction; a lower surface 30B (second lock surface) facing in the connector removal direction; and a pair of side surfaces 30C facing in the connector width anti-center direction. As shown in FIG. 16, a notch 35 is formed at an end portion of the contact holding portion 30 in the battery separating direction and penetrates in the connector insertion/removal direction.

As shown in FIG. 13, each insertion portion 31 is formed so as to project in the connector width anti-center direction from a lower portion of the corresponding side surface 30C of the contact holding portion 30. Each insertion portion 31 is elongated in the battery facing direction. Specifically, each insertion portion 31 includes a pair of holding projections 36 (projections), a lock beam 37 (beam), and a claw 38. The holding projections 36 included in each insertion portion 31 are portions projecting in the connector width anti-center direction from the corresponding side surface 30C of the contact holding portion 30. The holding projections 36 included in each insertion portion 31 are disposed at locations apart from each other in the battery facing direction. Each holding projection 36 includes a projection upper surface 36A (first lock surface) facing in the connector mating direction. The lock beam 37 is a cantilever that is supported by one of the holding projections 36 which is disposed at a location farther from the battery unit 3 than the other one of the pair of holding projections 36, and extends in the battery approaching direction. The claw 38 is formed so as to project in the connector width anti-center direction from a free end of the lock beam 37.

(Pin Contact 7)

Figure 17:
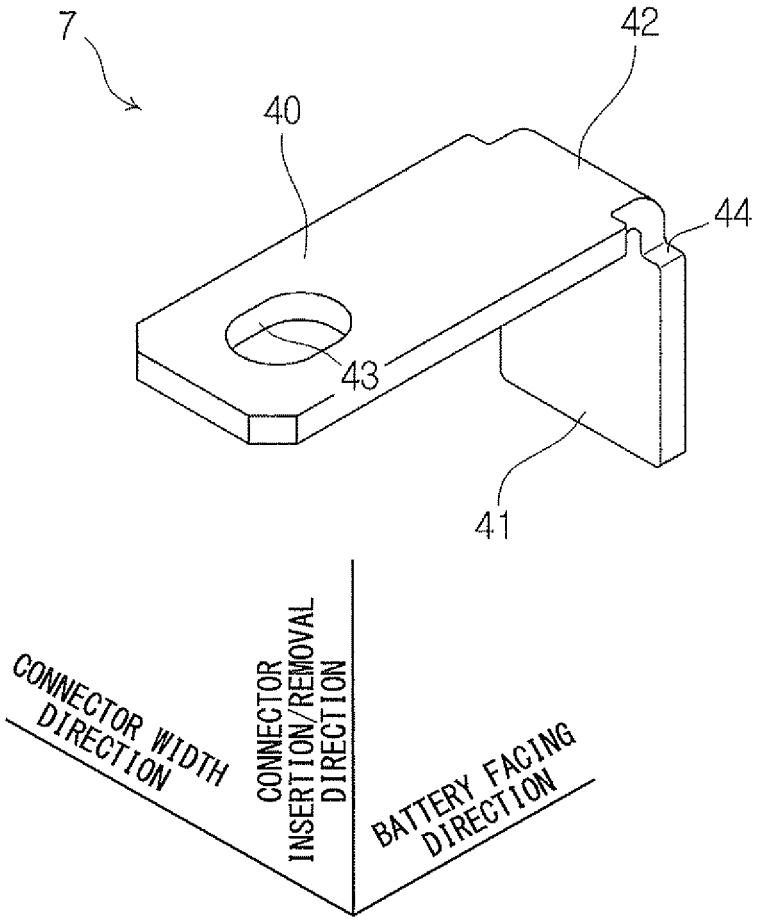
FIG. 17 is a perspective view of a pin contact (first embodiment)
Figure 18:
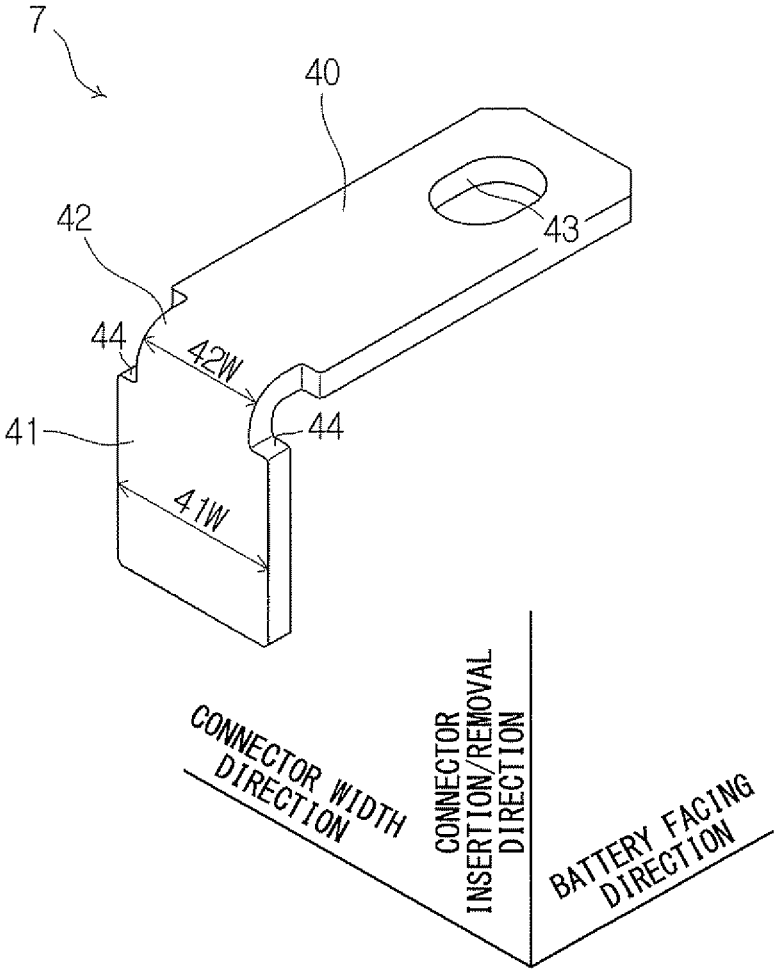
FIG. 18 is a perspective view of the pin contact when viewed from another angle (first embodiment)

FIGS. 17 and 18 illustrate the pin contact 7 when viewed from different directions. As shown in FIGS. 17 and 18, the pin contact 7 is formed by bending a metal plate with a thickness of about 3 mm. The pin contact 7 includes a battery fixing portion 40 (first contact portion) having a flat plate shape, a contact portion 41 (second contact portion) having a flat plate shape, and a coupling portion 42.

The thickness direction of the battery fixing portion 40 matches the connector insertion/removal direction. The battery fixing portion 40 extends in the battery facing direction. A fixing hole 43 for bolting is formed at an end portion in the battery approaching direction of the battery fixing portion 40. The thickness direction of the contact portion 41 matches the battery facing direction. The contact portion 41 extends in the connector insertion/removal direction. The coupling portion 42 is a portion that couples together the battery fixing portion 40 and the contact portion 41. In this embodiment, the thickness direction of the battery fixing portion 40 and the thickness direction of the contact portion 41 are substantially perpendicular to each other, and thus the pin contact 7 is formed into an L-shape. As shown in FIG. 18, a dimension 41W of the contact portion 41 in the connector width direction is greater than a dimension 42W of the coupling portion 42 in the connector width direction. Accordingly, the contact portion 41 includes a pair of contact lock surfaces 44 facing in the connector mating direction. The pair of contact lock surfaces 44 is disposed in such a manner that the contact lock surfaces 44 sandwich the coupling portion 42 in the connector width direction.

Next, a procedure for assembling the pin connector 5 will be described.

Figure 5:
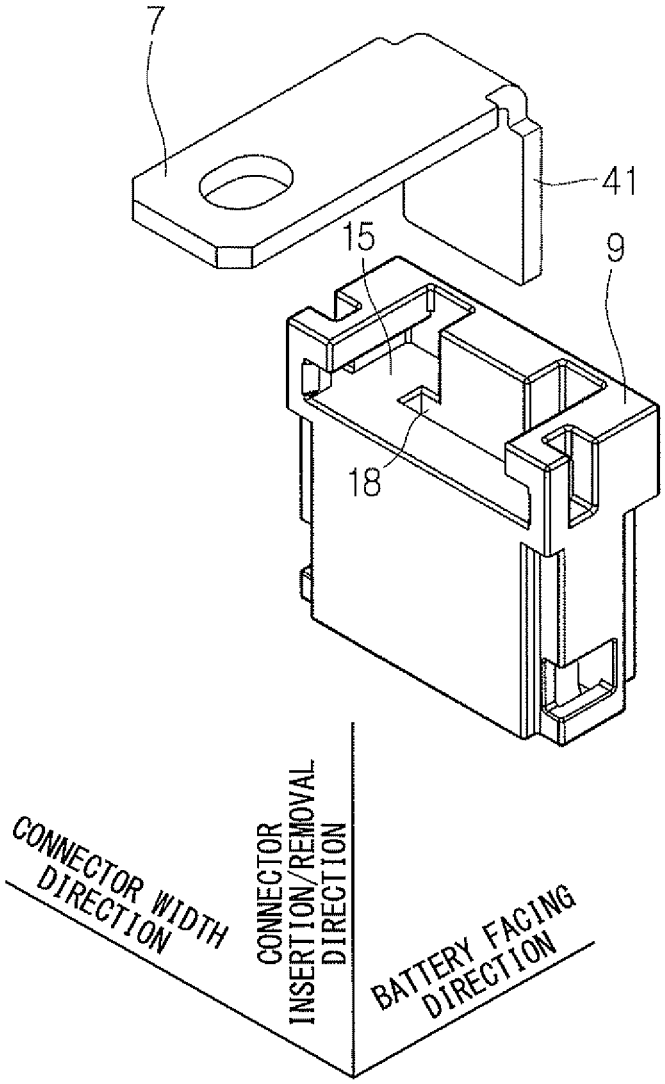
FIG. 5 is an explanatory diagram showing a procedure for assembling the pin connector (first embodiment)
Figure 6:
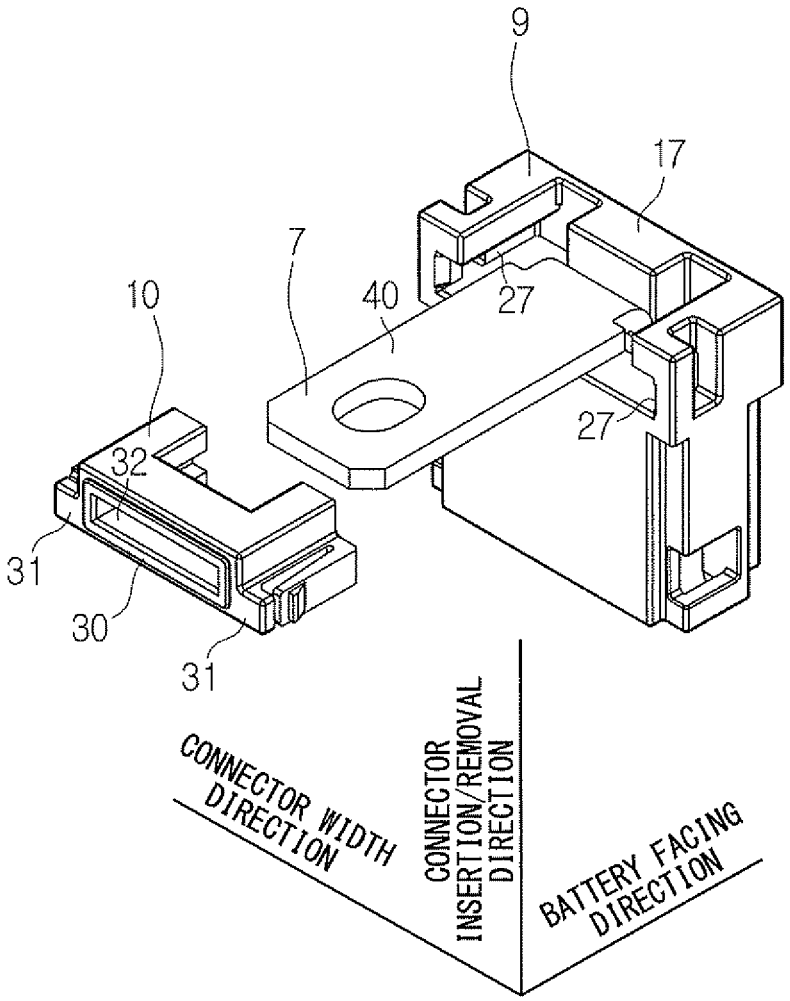
FIG. 6 is an explanatory diagram showing the procedure for assembling the pin connector (first embodiment)

First, as shown in FIGS. 5 and 6, the pin contact 7 is inserted into the pin housing body 9. The direction in which the pin contact 7 is inserted into the pin housing body 9 matches the connector removal direction. Specifically, the contact portion 41 of the pin contact 7 is inserted into the contact insertion hole 18 of the base plate 15 of the pin housing body 9.

Figure 7:
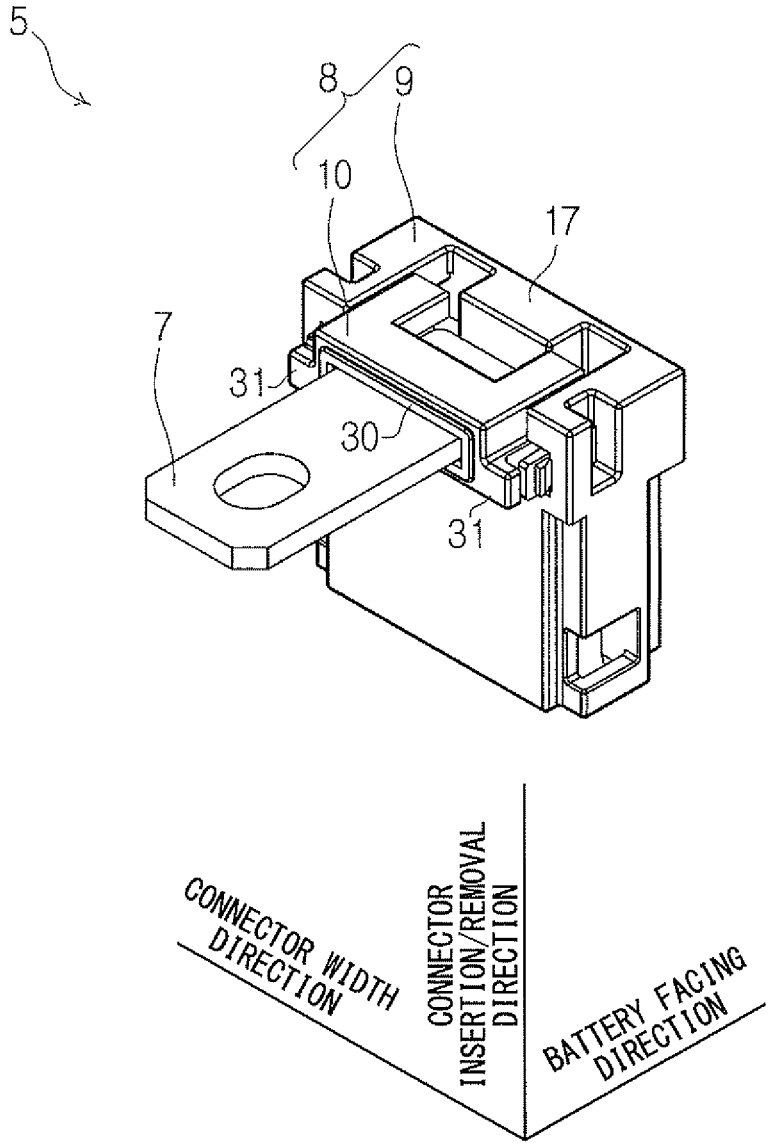
FIG. 7 is an explanatory diagram showing the procedure for assembling the pin connector (first embodiment)
Figure 8:
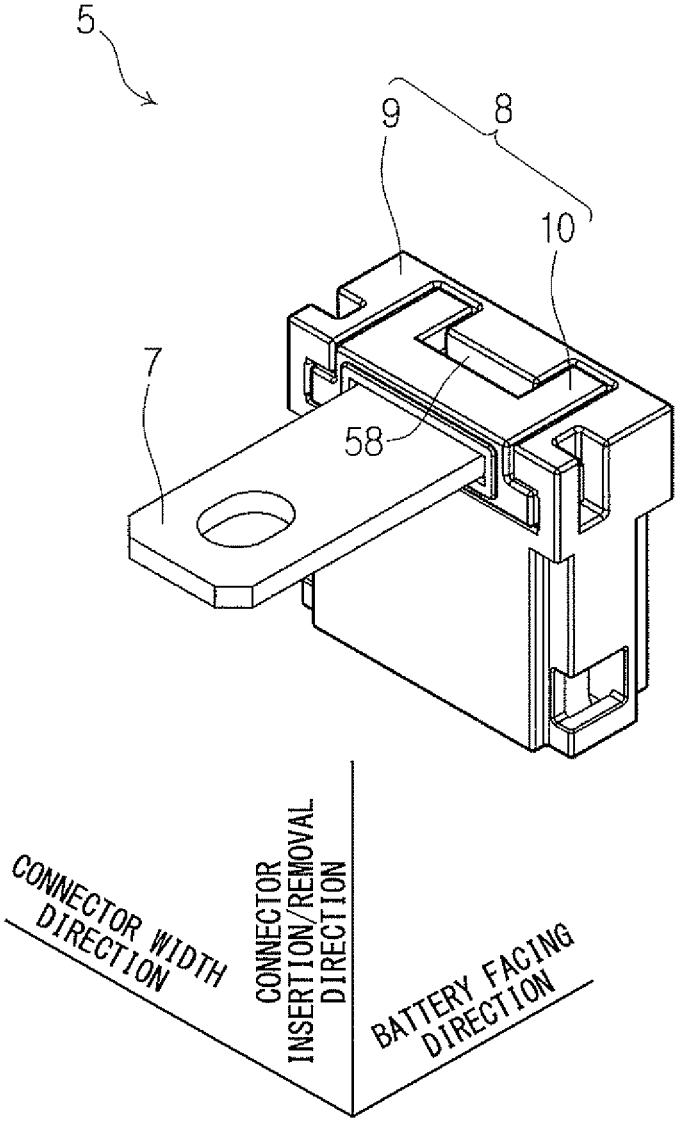
FIG. 8 is an explanatory diagram showing the procedure for assembling the pin connector (first embodiment)
Figure 19:
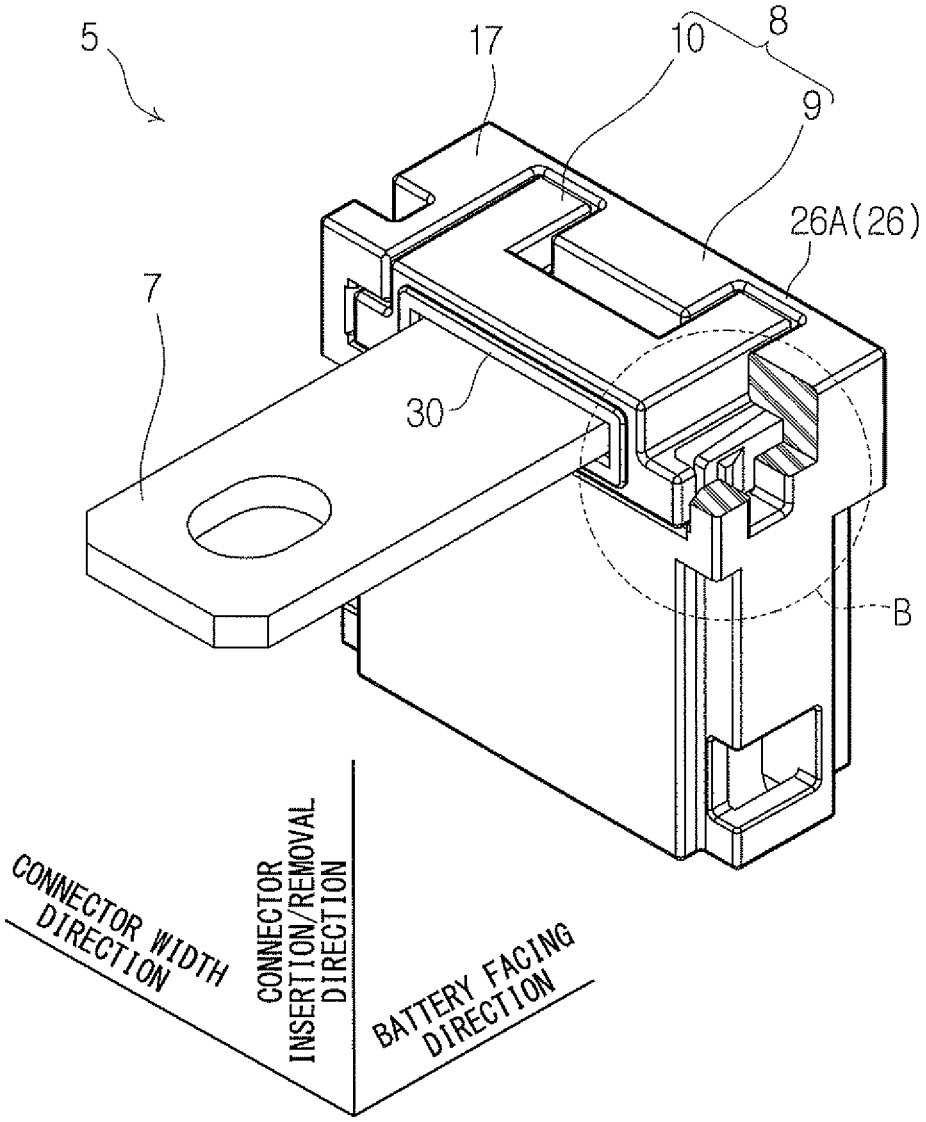
FIG. 19 is a partially cutaway perspective view of the pin connector (first embodiment)
Figure 20:
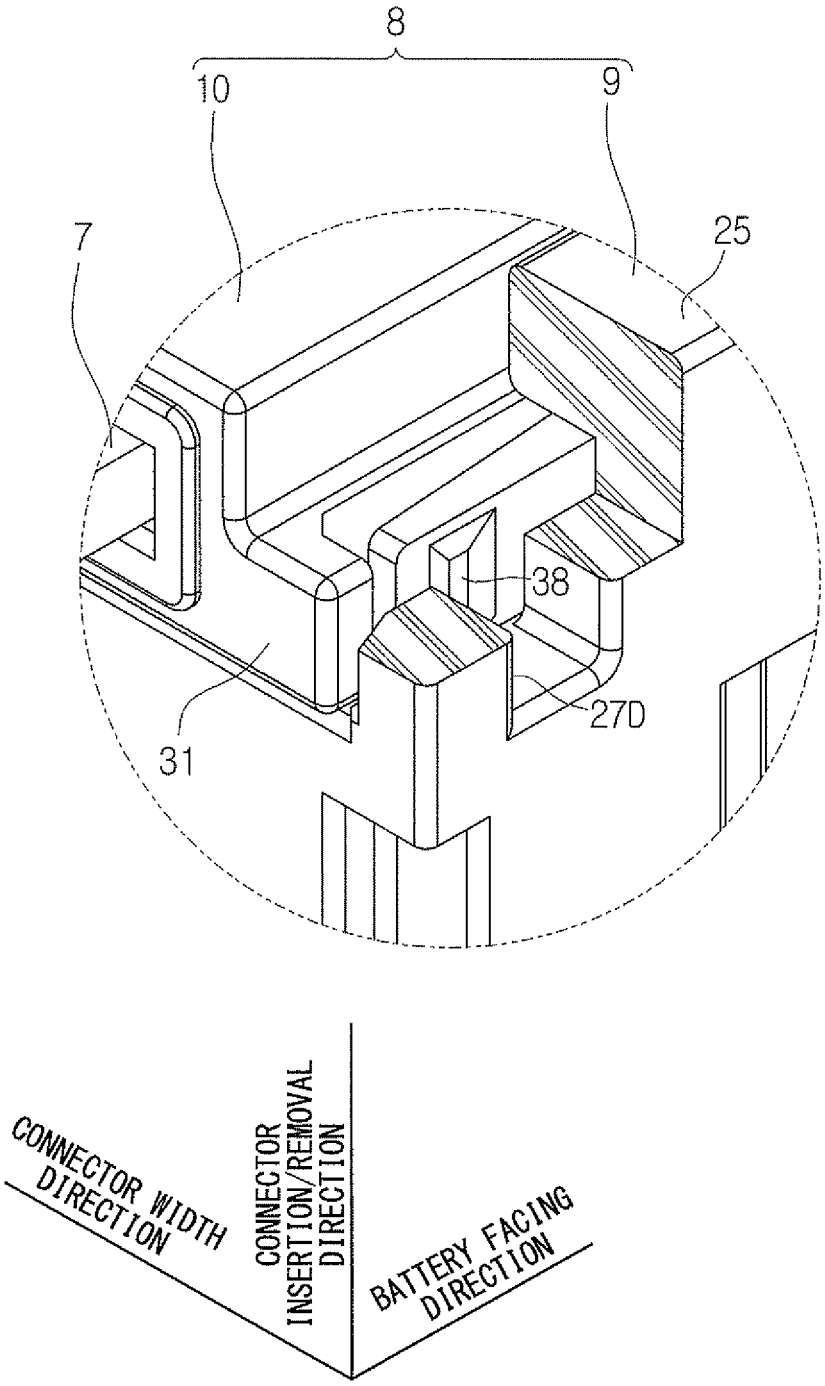
FIG. 20 is an enlarged view of a portion "B" shown in FIG. 19 (first embodiment)

Next, as shown in FIGS. 6 to 8, the pin contact lock 10 is attached to the pin housing body 9. The direction in which the pin contact lock 10 is attached to the pin housing body 9 matches the battery separating direction. Specifically, as shown in FIGS. 5 to 8, the pair of insertion portions 31 of the pin contact lock 10 is inserted into the pair of insertion grooves 27 of the pin contact lock accommodating portion 17 of the pin housing body 9, while the battery fixing portion 40 of the pin contact 7 is inserted into the contact through-hole 32 of the contact holding portion 30 of the pin contact lock 10. Then, as shown in FIGS. 19 and 20, the claws 38 of the pair of insertion portions 31 of the pin contact lock 10 are hooked on the hook surfaces 27D of the pair of lock holding walls 25, respectively, thereby inhibiting the pin contact lock 10 from being removed from the pin housing body 9. Further, as shown in FIG. 19, the contact holding portion 30 is brought into contact with the abutting wall body 26A of the lock abutting wall 26, thereby inhibiting the pin contact lock 10 from being further inserted in the battery separating direction.

When the pin connector 5 is assembled in this manner, first, the contact lock surfaces 44 shown in FIG. 18 and the lower surface 30B of the contact holding portion 30 shown in FIG. 15 face each other in the connector insertion/removal direction. Second, the pair of projection upper surfaces 36A of each insertion portion 31 shown in FIG. 13 and the groove ceiling 27B shown in FIG. 11 face each other in the connector insertion/removal direction. With this structure, a movement of the pin contact 7 relative to the pin housing 8 in the connector mating direction is inhibited. In other words, a movement of the pin housing 8 relative to the pin contact 7 in the connector removal direction is inhibited.

Figure 21:
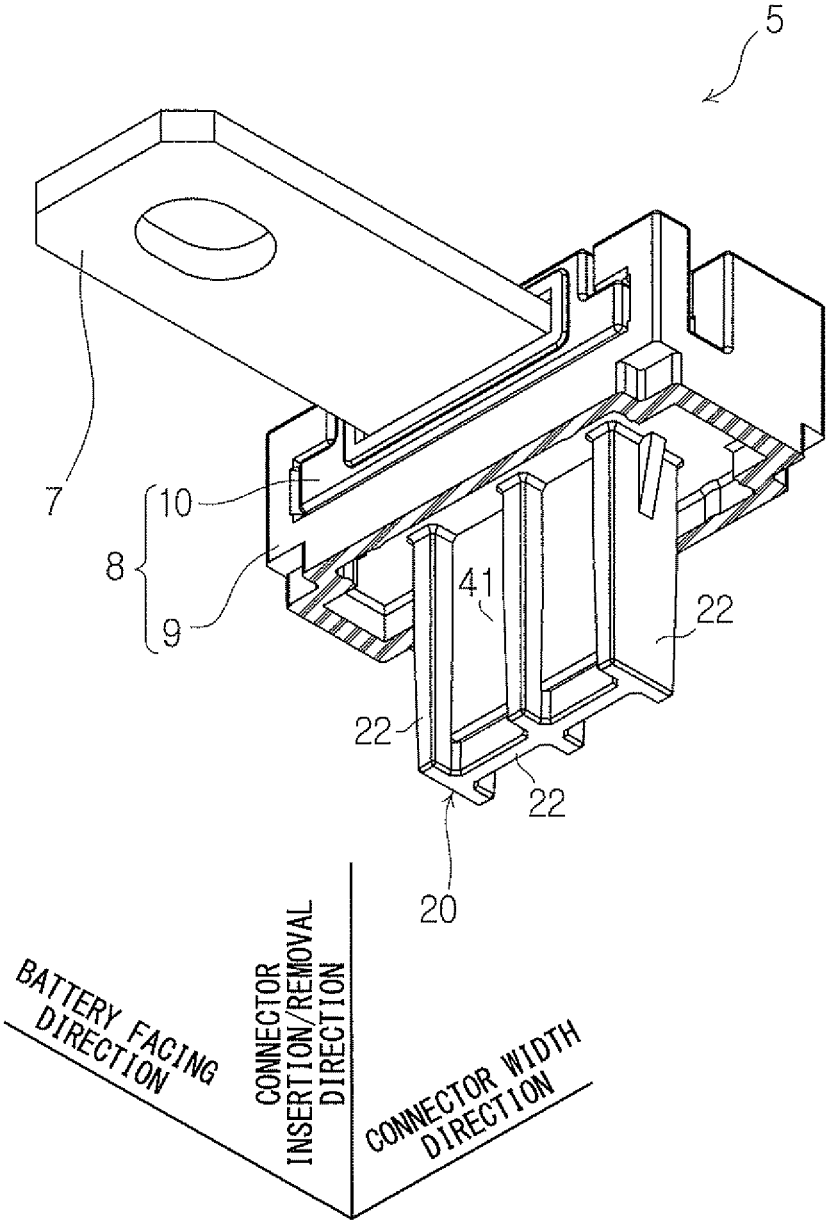
FIG. 21 is a partially cutaway perspective view of the pin connector when viewed from another angle (first embodiment)

FIG. 21 shows a state where the contact portion 41 of the pin contact 7 is accommodated in the inside cover 20. The inside cover 20 is formed of a plurality of beams 22, and thus the contact portion 41 is partially exposed to the outside in a state where the contact portion 41 is accommodated in the inside cover 20.

(Socket Connector 6)

Figure 22:
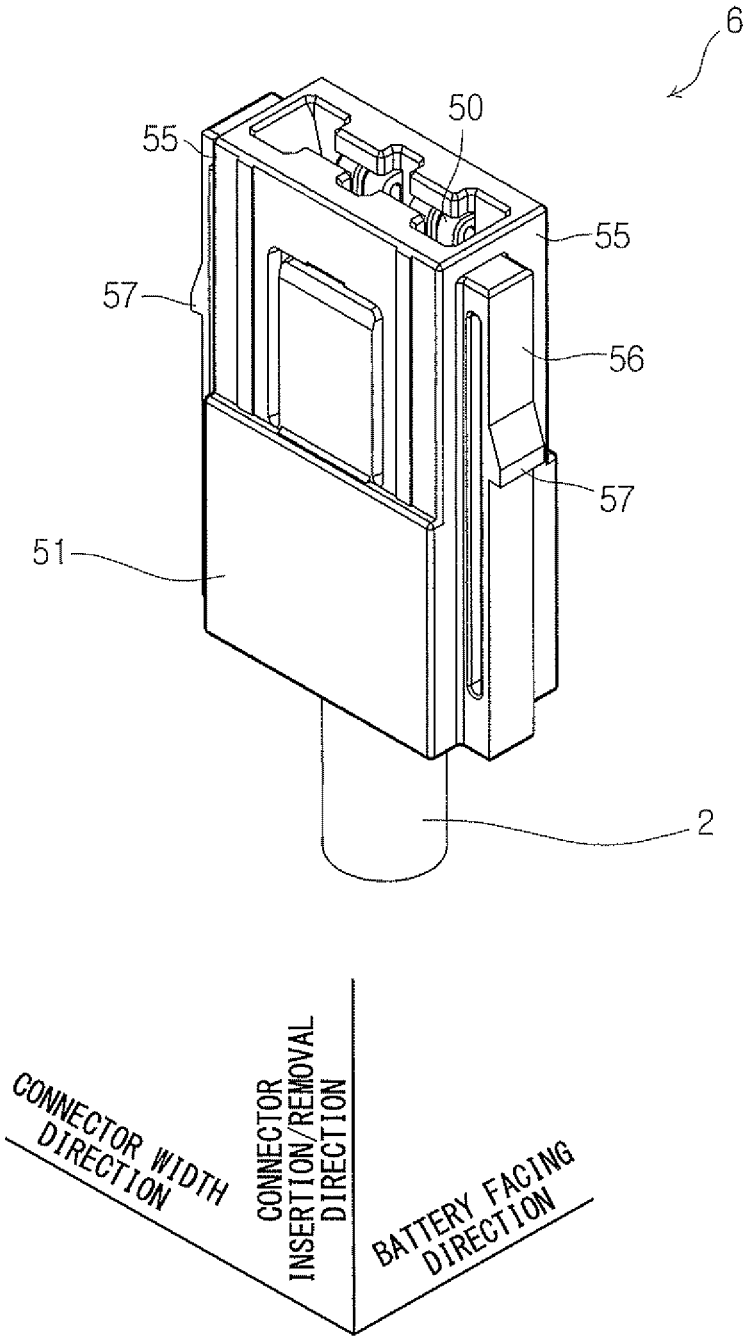
FIG. 22 is a perspective view of the socket connector (first embodiment)
Figure 23:
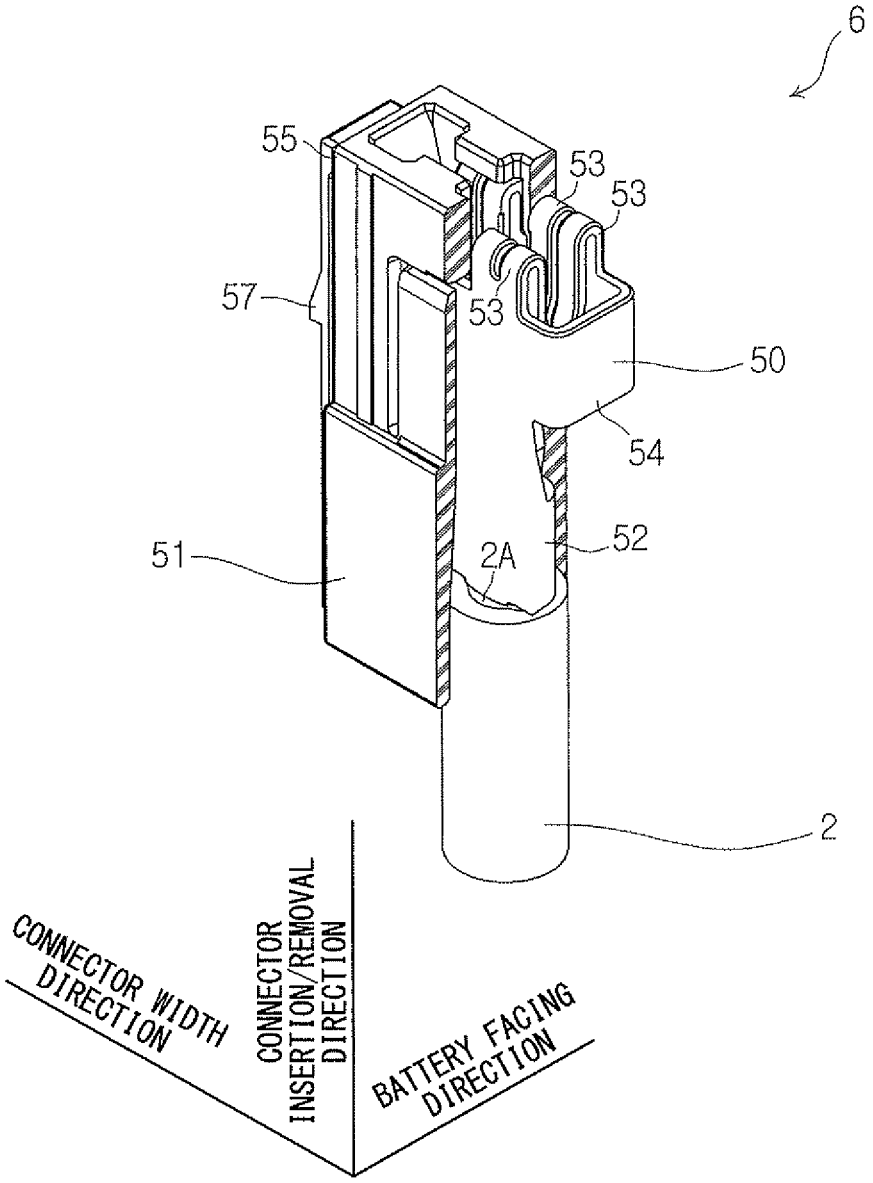
FIG. 23 is a partially cutaway perspective view of the socket connector (first embodiment)

Next, the socket connector 6 will be described with reference to FIGS. 22 and 23. FIGS. 22 and 23 show the socket connector 6 which is attached to the electric wire 2.

As shown in FIGS. 22 and 23, the socket connector 6 includes a socket contact 50 and a socket housing 51 that accommodates the socket contact 50.

As shown in FIG. 23, the socket contact 50 includes: a crimp portion 52 that is crimped onto a conductor 2A of the electric wire 2; eight elastic pieces 53; and an elastic piece support portion 54 that supports the eight elastic pieces 53.

As shown in FIG. 22, the socket housing 51 is formed so as to have a rectangular tubular shape extending in the connector insertion/removal direction. The socket housing 51 includes a pair of side walls 55 facing each other in the connector width direction. Each side wall 55 is provided with a beam 56 in which both ends thereof are supported by the side wall 55, and a mating claw 57 projecting in the connector width anti-center direction from a middle portion of the beam 56 in the longitudinal direction thereof.

Next, the usage of the connector assembly 1 will be described.

First, the pin contact 7 of the pin connector 5 is fixed to the external terminal 4 shown in FIG. 1 with a bolt by using the fixing hole 43 of the battery fixing portion 40 shown in FIG. 17.

Figure 24:
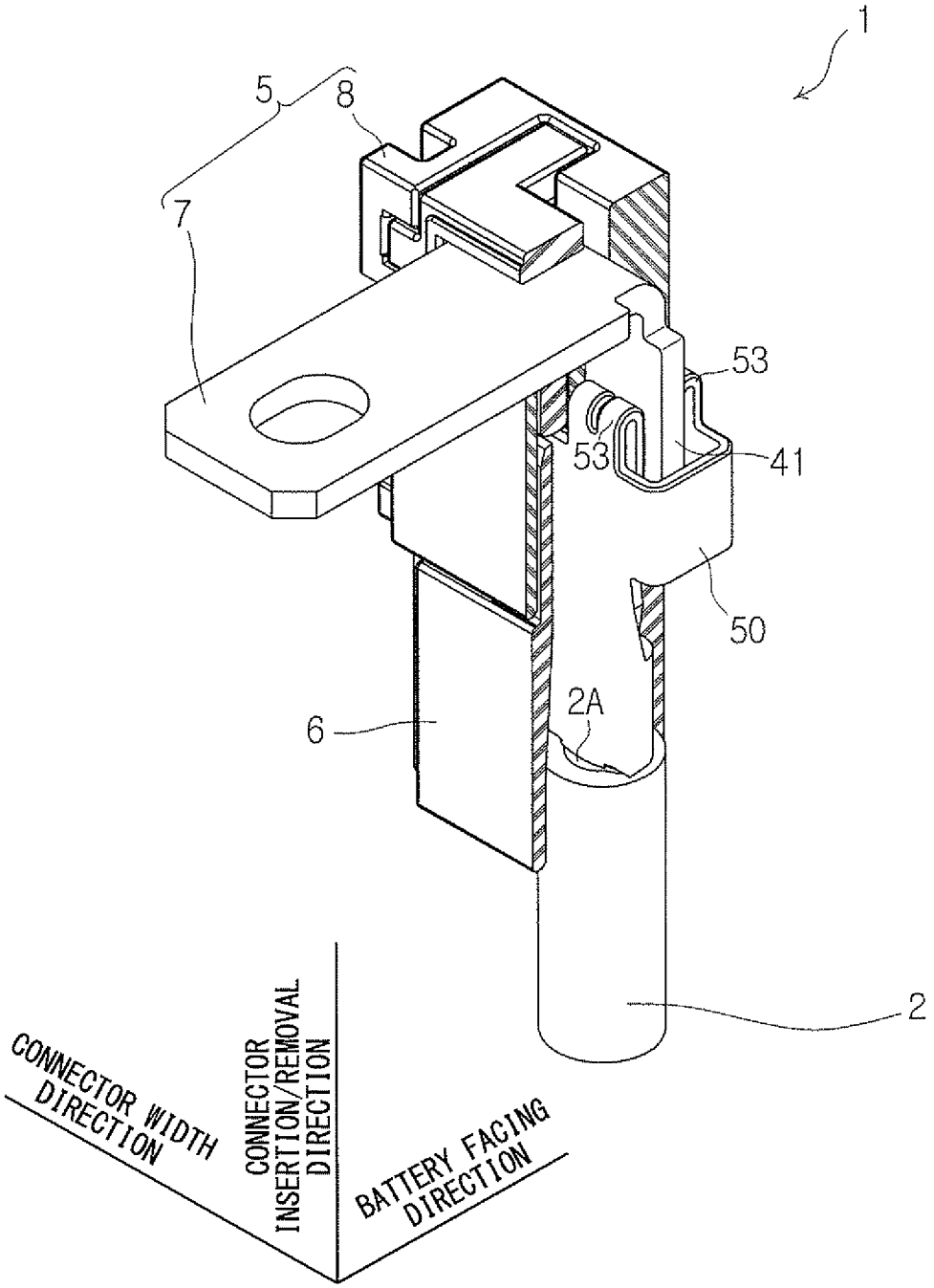
FIG. 24 is a partially cutaway perspective view in a state where the pin connector is mated to the socket connector (first embodiment)

Next, as shown in FIGS. 1 and 2, the socket connector 6 is mated to the pin connector 5. Then, as shown in FIG. 24, the eight elastic pieces 53 of the socket contact 50 are brought into contact with the contact portion 41 of the pin contact 7, so that the conductor 2A of the electric wire 2 is electrically connected to the external terminal 4 of the battery unit 3.

The mating claws 57 shown in FIG. 22 are respectively hooked on the claw mating surfaces 19C shown in FIG. 9, thereby inhibiting unintended removal of the socket connector 6 from the pin connector 5.

To remove the socket connector 6 from the pin connector 5, the socket connector 6 may be pulled down in the connector removal direction after the beams 56 shown in FIG. 22 are bent in the connector width center direction to release the hook of the pair of mating claws 57 from the pair of claw mating surfaces 19C shown in FIG. 9.

The first embodiment described above has the following features.

(1) The pin connector 5 (electric connector) is attached to the battery unit 3 (connection object) and is mated to the socket connector 6 (mating connector) attached to the electric wire 2, thereby electrically connecting the electric wire 2 to the battery unit 3. The pin connector 5 includes the pin contact 7 (contact) and the pin housing 8 attached to the pin contact 7. The pin contact 7 includes: the flat-plate-shaped battery fixing portion 40 (first contact portion) configured to be fixed to the external terminal 4 of the battery unit 3; and the flat-plate-shaped contact portion 41 (second contact portion) configured to be in contact with the socket contact 50 of the socket connector 6. The pin housing 8 includes: the pin housing body 9 (housing body) into which the contact portion 41 is inserted in the connector removal direction (removal direction); and the pin contact lock 10 (contact lock) attached to the pin housing body 9. The pin contact lock 10 includes: the projection upper surface 36A (first lock surface) facing in the connector mating direction (mating direction); and the lower surface 30B (second lock surface) facing in the connector removal direction. The pin housing body 9 includes the groove ceiling 27B (housing lock surface) facing in the connector removal direction. The pin contact 7 includes the contact lock surface 44 facing in the connector mating direction. When the pin contact lock 10 is inserted into the pin housing body 9 in the battery separating direction to be attached to the pin housing body 9, the projection upper surface 36A faces the groove ceiling 27B and the lower surface 30B faces the contact lock surface 44. Specifically, when the pin contact lock 10 is inserted into the pin housing body 9 in the battery separating direction to be attached to the pin housing body 9, the projection upper surface 36A faces the groove ceiling 27B in the connector insertion/removal direction in such a manner that the projection upper surface 36A is capable of being in contact with the groove ceiling 27B, and the lower surface 30B faces the contact lock surface 44 in the connector insertion/removal direction in such a manner that the lower surface 30B is capable of being in contact with the contact lock surface 44. According to the above structure, the pin contact 7 is reliably fixed to the pin housing body 9. Therefore, it is possible to prevent the electrical connection between the electric wire 2 and the battery unit 3 from being lost due to detachment of the pin housing 8 from the pin contact 7 when an external force acts on the pin housing body 9 in the connector removal direction, for example, when the electric wire 2 is pulled in the connector removal direction.

(2) The pin housing 8 is configured in such a manner that as the pin contact lock 10 is removed from the pin housing body 9, the pin contact lock 10 approaches the battery unit 3. According to the above structure, when the pin contact lock 10 is about to be removed from the pin housing body 9 due to some cause, the pin contact lock 10 approaches the battery unit 3 and contacts the battery unit 3, which may prevent the pin contact lock 10 from being completely detached from the pin housing body 9.

(3) In this embodiment, the pin contact 7 is formed into an L-shape in which the thickness direction of the battery fixing portion 40 and the thickness direction of the contact portion 41 are substantially perpendicular to each other.

(5) The pin housing 8 includes: the contact through-hole 32 (first opening) which is penetrable by the pin contact 7 and opens toward the battery unit 3; and a contact through-hole 58 (second opening; see FIG. 8) which is penetrable by the pin contact 7 and opens in the connector mating direction. The contact through-hole 58 is formed as a gap between the pin housing body 9 and the pin contact lock 10 in the battery facing direction. According to the above structure, it is possible to realize the pin housing 8 which is adaptable to: the L-shaped pin contact 7 in which the thickness direction of the battery fixing portion 40 and the thickness direction of the contact portion 41 are substantially perpendicular to each other; the crank-type pin contact in which the thickness direction of the battery fixing portion 40 and the thickness direction of the contact portion 41 are substantially parallel to each other and the battery fixing portion 40 and the contact portion 41 are misaligned in the thickness direction of the battery fixing portion 40; and the straight-type pin contact in which the battery fixing portion 40 and the contact portion 41 are linearly arranged.

(6) The pin housing body 9 includes the insertion groove 27 extending in the battery facing direction (insertion direction in which the pin contact lock 10 is inserted into the pin housing body 9). The pin contact lock 10 includes the insertion portion 31 which is capable of being accommodated in the insertion groove 27 of the pin housing body 9. The projection upper surface 36A of the pin contact lock 10 is formed on the insertion portion 31. The groove ceiling 27B of the pin housing body 9 is formed on the insertion groove 27.

(7) The insertion portion 31 includes: the lock beam 37 (beam) extending along the battery facing direction; and the claw 38 formed on the lock beam 37. The pin housing body 9 includes the hook surface 27D on which the claw 38 of the insertion portion 31 inserted into the insertion groove 27 is hooked. According to the above structure, the lock beam 37 and the claw 38 of the insertion portion 31 are accommodated in the insertion groove 27 in a state where the pin contact lock 10 is attached to the pin housing body 9, so that the lock beam 37 and the claw 38 of the insertion portion 31 are less likely to be damaged.

(8) The insertion portion 31 includes the pair of holding projections 36 (projections) sandwiching the lock beam 37 in the battery facing direction. The projection upper surfaces 36A of the pin contact lock 10 are respectively formed on the pair of holding projections 36 of the insertion portion 31.

(9) The lock beam 37 is a cantilever supported by one of the pair of the holding projections 36.

Second Embodiment

Next, a second embodiment will be described with reference to FIGS. 25 to 27. Differences between the first embodiment and the second embodiment will be mainly described, while repetitions of previous descriptions are omitted.

Figure 25:
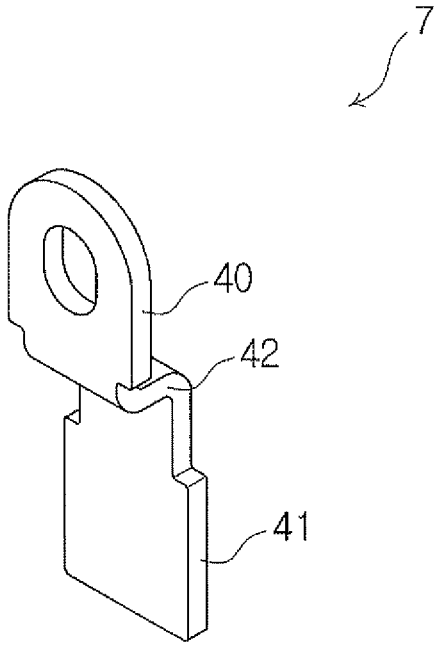
FIG. 25 is a perspective view of a pin contact (second embodiment)

As shown in FIG. 25, the pin contact 7 of this embodiment is formed into a crank shape in which the thickness direction of the battery fixing portion 40 and the thickness direction of the contact portion 41 are substantially parallel to each other and the battery fixing portion 40 and the contact portion 41 are misaligned in the thickness direction of the battery fixing portion 40.

Figure 26:
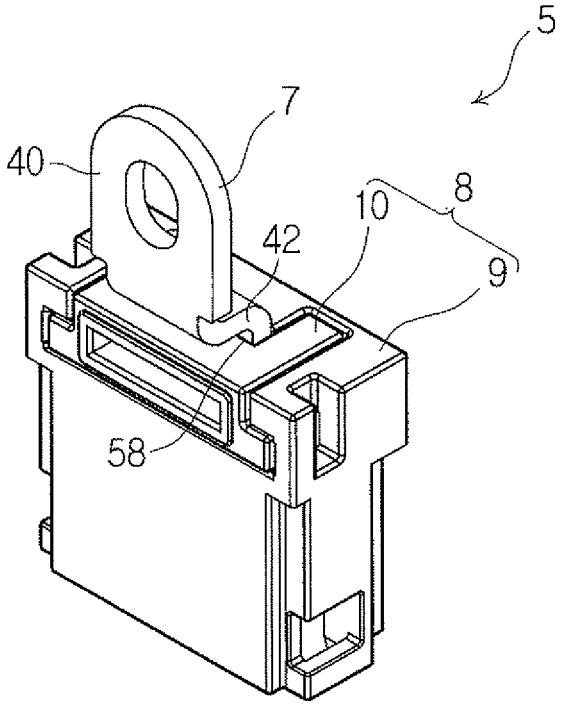
FIG. 26 is a perspective view of a pin connector (second embodiment)

FIG. 26 illustrates a state where the pin housing 8 is attached to the pin contact 7. As shown in FIGS. 25 and 26, the battery fixing portion 40 of the pin contact 7 is shifted with respect to the contact portion 41 in the direction opposite to the insertion direction in which the pin contact lock 10 is inserted into the pin housing body 9. The coupling portion 42 of the pin contact 7 penetrates the contact through-hole 58.

Figure 27:
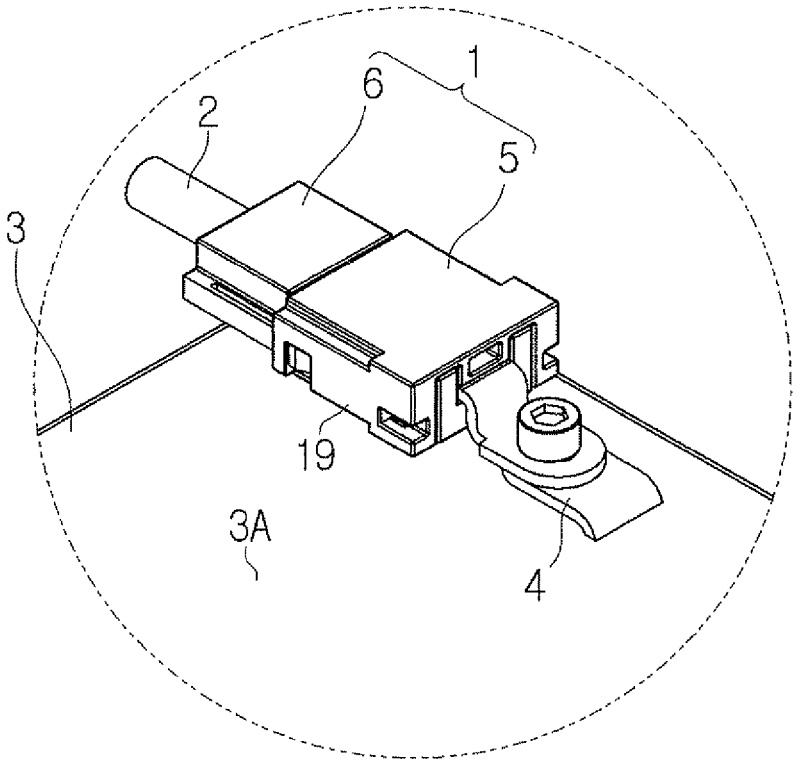
FIG. 27 is a perspective view showing a state where the pin connector is attached to a battery unit (second embodiment)

FIG. 27 shows a state where the pin connector 5 of this embodiment is attached to the external terminal 4 of the battery unit 3. As shown in FIG. 27, in this embodiment, the pin connector 5 is fixed to the external terminal 4 of the battery unit 3 with a bolt so that the projecting direction of the outside cover 19 is parallel to the upper surface 3A of the battery unit 3. According to the above structure, the direction in which the electric wire 2 is drawn out can be set to be parallel to the upper surface 3A of the battery unit 3.

(2) Also in this embodiment, like in the first embodiment described above, the pin housing 8 is configured in such a manner that when the pin contact lock 10 is removed from the pin housing body 9, the pin contact lock 10 approaches the battery unit 3. Accordingly, when the pin contact lock 10 is about to be removed from the pin housing body 9 due to some cause, the pin contact lock 10 approaches the battery unit 3 and contacts the battery unit 3, which may prevent the pin contact lock 10 from being completely detached from the pin housing body 9.

Third Embodiment

Next, a third embodiment will be described with reference to FIGS. 28 and 29. Differences between the first embodiment and the third embodiment will be mainly described, while repetitions of previous descriptions are omitted.

Figure 28:
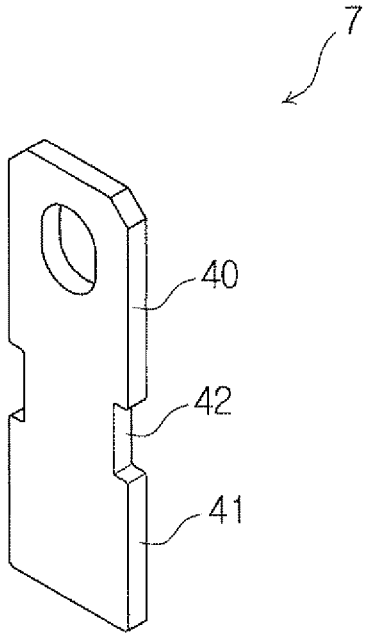
FIG. 28 is a perspective view of a pin contact (third embodiment)

As shown in FIG. 28, the pin contact 7 of this embodiment is formed into a straight shape in which the battery fixing portion 40 and the contact portion 41 are linearly arranged.

Figure 29:
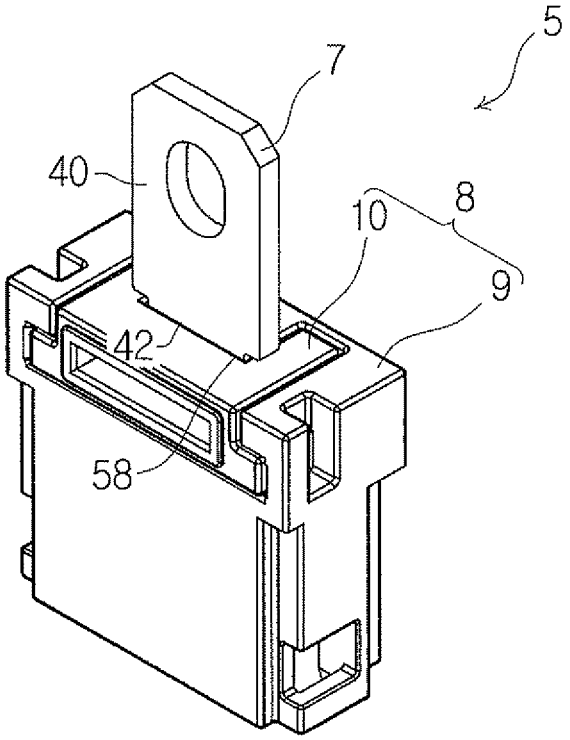
FIG. 29 is a perspective view of a pin connector (third embodiment)
Figure 30:
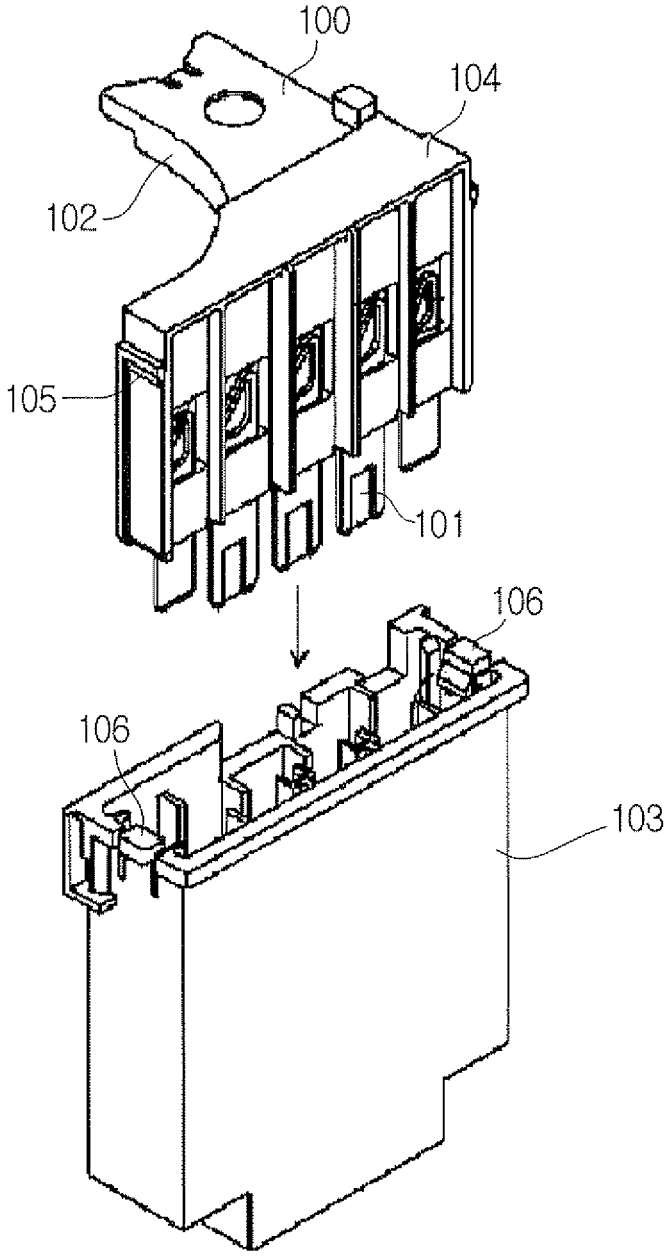
FIG. 30 is a view corresponding to FIG. 1 of Patent Literature 1.

FIG. 29 illustrates a state where the pin housing 8 is attached to the pin contact 7. As shown in FIG. 29, the coupling portion 42 of the pin contact 7 penetrates the contact through-hole 58.

The first to third embodiments of the present invention have been described above. It is notable that the pin housing 8 includes: the contact through-hole 32 (first opening) which is penetrable by the pin contact 7 and opens toward the battery unit 3; and the contact through-hole 58 (second opening; see FIG. 8) which is penetrable by the pin contact 7 and opens in the connector mating direction. With this structure, the pin housing 8 can accommodate the pin contact 7 without any problem even when the shapes of the pin contacts 7 are quite different from each other as shown in the first to third embodiments described above.

This application is based upon and claims the benefit of priority from Japanese patent application No. 2014-112215, filed on May 30, 2014, the disclosure of which is incorporated herein in its entirety by reference.

REFERENCE SIGNS LIST

1 CONNECTOR ASSEMBLY
2 ELECTRIC WIRE
2A CONDUCTOR
3 BATTERY UNIT (CONNECTION OBJECT)
3A UPPER SURFACE
3B SIDE SURFACE
4 EXTERNAL TERMINAL
5 PIN CONNECTOR (ELECTRIC CONNECTOR)
6 SOCKET CONNECTOR (MATING CONNECTOR)
7 PIN CONTACT (CONTACT)
8 PIN HOUSING
9 PIN HOUSING BODY (HOUSING BODY)
10 PIN CONTACT LOCK (CONTACT LOCK)
15 BASE PLATE
16 MATING PORTION
17 PIN CONTACT LOCK ACCOMMODATING PORTION
18 CONTACT INSERTION HOLE
19 OUTSIDE COVER
19A LARGE SIDE WALL
19B SMALL SIDE WALL
19C CLAW MATING SURFACE
20 INSIDE COVER
21 CONTACT ACCOMMODATION SPACE
22 BEAM
25 LOCK HOLDING WALL
25A WALL SURFACE
26 LOCK ABUTTING WALL
26A ABUTTING WALL BODY
26B ABUTTING WALL PROJECTING PORTION
27 INSERTION GROOVE
27A GROOVE SIDE SURFACE
27B GROOVE CEILING (HOUSING LOCK SURFACE)
27C HOOK HOLE
27D HOOK SURFACE
30 CONTACT HOLDING PORTION

30A UPPER SURFACE
30B LOWER SURFACE (SECOND LOCK SURFACE)
30C SIDE SURFACE
31 INSERTION PORTION
32 CONTACT THROUGH-HOLE (FIRST OPENING)
33 CONTACT HOLD-DOWN SURFACE
35 NOTCH
36 HOLDING PROJECTION (PROJECTION)
36A PROJECTION UPPER SURFACE (FIRST LOCK SURFACE)
37 LOCK BEAM (BEAM)
38 CLAW
40 BATTERY FIXING PORTION (FIRST CONTACT PORTION)
41 CONTACT PORTION (SECOND CONTACT PORTION)
41W DIMENSION
42 COUPLING PORTION
42W DIMENSION
43 FIXING HOLE
44 CONTACT LOCK SURFACE
50 SOCKET CONTACT
51 SOCKET HOUSING
52 CRIMP PORTION
53 ELASTIC PIECE
54 ELASTIC PIECE SUPPORT PORTION
55 SIDE WALL
56 BEAM
57 MATING CLAW
58 CONTACT THROUGH-HOLE (SECOND OPENING)

The invention claimed is:

1. An electric connector configured to be attached to a connection object, the electric connector being configured to be mated to a mating connector attached to an electric wire to thereby electrically connect the electric wire to the connection object, the electric connector comprising:

a contact;

a housing attached to the contact, wherein the contact includes a first contact portion having a flat plate shape and a second contact portion having a flat plate shape, the first contact portion being configured to be fixed to the connection object, the second contact portion being configured to be in contact with the mating connector, the housing comprises: a housing body into which the second contact portion is inserted in a removal direction; and a contact lock attached to the housing body, the removal direction being opposite to a mating direction in which the mating connector is mated to the electric connector, the contact lock includes a first lock surface facing in the mating direction and a second lock surface facing in the removal direction, the housing body includes a housing lock surface facing in the removal direction, the contact includes a contact lock surface facing in the mating direction, when the contact lock is inserted into the housing body in a direction substantially orthogonal to the removal direction to be attached to the housing body, the first lock surface faces the housing lock surface and the second lock surface faces the contact lock surface, and the contact is formed into an L-shape in which a thickness direction of the first contact portion and a thickness direction of the second contact portion are substantially perpendicular to each other.

2. The electric connector according to claim 1, wherein the housing is configured such that when the contact lock is removed from the housing body, the contact lock approaches the connection object.

3. The electric connector according to claim 1, wherein the housing includes a first opening and a second opening, the first opening being penetrable by the contact and opening toward the connection object, the second opening being penetrable by the contact and opening in the mating direction.

4. The electronic connector according to claim 1, wherein the housing body includes an insertion groove extending in an insertion direction in which the contact lock is inserted into the housing body, the contact lock includes an insertion portion accommodated in the insertion groove of the housing body, the first lock surface of the contact lock is formed on the insertion portion, and the housing lock surface of the housing body is formed on the insertion groove.

5. The electric connector according to claim 4, wherein the insertion portion includes a beam extending along the insertion direction, and a claw formed on the beam, and the housing body includes a hook surface on which the claw of the insertion portion inserted in the insertion groove is hooked.

6. The electric connector according to claim 5, wherein the insertion portion includes a pair of projections sandwiching the beam in the insertion direction, and the first lock surface of the contact lock is formed on the pair of projections of the insertion portion.

7. The electric connector according to claim 6, wherein the beam is a cantilever supported by one of the pair of projections.

8. The electric connector according to claim 1, wherein the contact lock includes a contact through-hole that the first contact portion is inserted into.

9. An electric connector configured to be attached to a connection object, the electric connector being configured to be mated to a mating connector attached to an electric wire to thereby electrically connect the electric wire to the connection object, the electric connector comprising:

a contact; and a housing attached to the contact, wherein the contact includes a first contact portion having a flat plate shape and a second contact portion having a flat plate shape, the first contact portion being configured to be fixed to the connection object, the second contact portion being configured to be in contact with the mating connector, the housing includes: a housing body into which the second contact portion is inserted in a removal direction; and a contact lock attached to the housing body, the removal direction being opposite to a mating direction in which the mating connector is mated to the electric connector, the contact lock includes a first lock surface facing in the mating direction and a second lock surface facing in the removal direction, the housing body includes a housing lock surface facing in the removal direction, the contact includes a contact lock surface facing in the mating direction, when the contact lock is inserted into the housing body in a direction substantially orthogonal to the removal direction to be attached to the housing body, the first lock surface faces the housing lock surface and the second lock surface faces the contact lock surface, and the contact is formed into a crank shape in which a thickness direction of the first contact portion and a thickness direction of the second contact portion are substantially parallel to each other and the first contact portion and the second contact portion are misaligned in the thickness direction of the first contact portion.

10. The electric connector according to claim 9, wherein the housing is configured such that when the contact lock is removed from the housing body, the contact lock approaches the connection object.

11. The electric connector according to claim 9, wherein the housing includes a first opening and a second opening, the first opening being penetrable by the contact and opening toward the connection object, the second opening being penetrable by the contact and opening in the mating direction.

12. The electronic connector according to claim 9, wherein the housing body includes an insertion groove extending in an insertion direction in which the contact lock is inserted into the housing body, the contact lock includes an insertion portion accommodated in the insertion groove of the housing body, the first lock surface of the contact lock is formed on the insertion portion, and the housing lock surface of the housing body is formed on the insertion groove.

13. The electric connector according to claim 12, wherein the insertion portion includes a beam extending along the insertion direction, and a claw formed on the beam, and the housing body includes a hook surface on which the claw of the insertion portion inserted in the insertion groove is hooked.

14. The electric connector according to claim 13, wherein the insertion portion includes a pair of projections sandwiching the beam in the insertion direction, and the first lock surface of the contact lock is formed on the pair of projections of the insertion portion.

15. The electric connector according to claim 14, wherein the beam is a cantilever supported by one of the pair of projections.

16. An electric connector configured to be attached to a connection object, the electric connector being configured to be mated to a mating connector attached to an electric wire to thereby electrically connect the electric wire to the connection object, the electric connector comprising:

a contact; and a housing attached to the contact, wherein the contact includes a first contact portion having a flat plate shape and a second contact portion having a flat plate shape, the first contact portion being configured to be fixed to the connection object, the second contact portion being configured to be in contact with the mating connector, the housing includes: a housing body into which the second contact portion is inserted in a removal direction; and a contact lock attached to the housing body, the removal direction being opposite to a mating direction in which the mating connector is mated to the electric connector, the contact lock includes a first lock surface facing in the mating direction and a second lock surface facing in the removal direction, the housing body includes a housing lock surface facing in the removal direction, the contact includes a contact lock surface facing in the mating direction, when the contact lock is inserted into the housing body in a direction substantially orthogonal to the removal direction to be attached to the housing body, the first lock surface faces the housing lock surface and the second lock surface faces the contact lock surface, the housing body includes an insertion groove extending in an insertion direction in which the contact lock is inserted into the housing body, the contact lock includes an insertion portion accommodated in the insertion groove of the housing body, the first lock surface of the contact lock is formed on the insertion portion, the housing lock surface of the housing body is formed on the insertion groove, the insertion portion includes a beam extending along the insertion direction, and a claw formed on the beam, and the housing body includes a hook surface on which the claw of the insertion portion inserted in the insertion groove is hooked.

17. The electric connector according to claim 16, wherein the housing is configured such that when the contact lock is removed from the housing body, the contact lock approaches the connection object.

18. The electric connector according to claim 16, wherein the housing includes a first opening and a second opening, the first opening being penetrable by the contact and opening toward the connection object, the second opening being penetrable by the contact and opening in the mating direction.

19. The electric connector according to claim 16, wherein the insertion portion includes a pair of projections sandwiching the beam in the insertion direction, and the first lock surface of the contact lock is formed on the pair of projections of the insertion portion.

20. The electric connector according to claim 19, wherein the beam is a cantilever supported by one of the pair of projections.

* * * * *